US008286734B2

(12) United States Patent
Hannegan et al.

(10) Patent No.: US 8,286,734 B2
(45) Date of Patent: Oct. 16, 2012

(54) LOW PROFILE ROTATING CONTROL DEVICE

(75) Inventors: Don M. Hannegan, Fort Smith, AR (US); Thomas F. Bailey, Houston, TX (US); James W. Chambers, Hackett, AR (US); David R. Woodruff, Fort Smith, AR (US); Simon J. Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 596 days.

(21) Appl. No.: 11/975,946

(22) Filed: Oct. 23, 2007

(65) Prior Publication Data

US 2009/0101411 A1 Apr. 23, 2009

(51) Int. Cl.
*E21B 33/03* (2006.01)

(52) U.S. Cl. ..... 175/214; 166/84.1

(58) Field of Classification Search ..... 166/84.1, 166/84.3, 84.4; 175/25, 214
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |
| 1,831,956 | A | 11/1931 | Harrington |
| 1,836,470 | A | 12/1931 | Humason et al. |

(Continued)

FOREIGN PATENT DOCUMENTS

CA 2363132 A1 9/2000

(Continued)

OTHER PUBLICATIONS

Cameron, The Modular T BOP Stack System, Brochure SD-100076, Apr. 1985 © 1985 Cameron Iron Works, Inc. (5 pages).

(Continued)

*Primary Examiner* — David Andrews
(74) *Attorney, Agent, or Firm* — Strasburger & Price, LLP

(57) ABSTRACT

A system and method are provided for a low profile rotating control device (LP-RCD) and its housing mounted on or integral with an annular blowout preventer seal, casing, or other housing. The outer diameter of the lateral outlet flange may be substantially the same as the height of the LP-RCD housing and bearing assembly after the bearing assembly is positioned with the LP-RCD housing. The sealing element may be aligned with the lateral outlet, and may be replaced from above. Different embodiments of attachment members for attaching the LP-RCD housing with a lower housing allow the LP-RCD housing to be rotated to align the lateral outlet with the drilling rig's existing line to mud pits or other locations. In one embodiment, the LP-RCD bearings are positioned radially inside the LP-RCD housing. In another embodiment, the LP-RCD bearings are positioned radially outside the LP-RCD housing. One embodiment allows rotation of the inserted tubular about multiple planes. In still another embodiment, an annular BOP seal is integral with a RCD housing.

53 Claims, 11 Drawing Sheets

U.S. PATENT DOCUMENTS

| | | | |
|---|---|---|---|
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Guiberson et al. |
| 2,144,682 | A | 1/1939 | MacClatchie |
| 2,148,844 | A | 2/1939 | Stone et al. |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,211,122 | A | 8/1940 | Howard |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeil et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,962,096 | A | 11/1960 | Knox |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,096,999 | A | 7/1963 | Ahlstone et al. |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,302,048 | A | 1/1967 | Gray |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,401,600 | A | 9/1968 | Wood |
| 3,405,763 | A | 10/1968 | Pitts et al. |
| 3,421,580 | A | 1/1969 | Fowler et al. |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,481,610 | A | 12/1969 | Slator et al. |
| 3,485,051 | A | 12/1969 | Watkins |
| 3,492,007 | A | 1/1970 | Jones |
| 3,493,043 | A | 2/1970 | Watkins |
| 3,503,460 | A | 3/1970 | Gadbois |
| 3,522,709 | A | 8/1970 | Vilain |
| 3,529,835 | A | 9/1970 | Lewis |
| 3,561,723 | A | 2/1971 | Cugini |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,741,296 | A | 6/1973 | Murman et al. |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,872,717 | A | 3/1975 | Fox |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,052,703 | A | 10/1977 | Collins, Sr. et al. |
| 4,053,023 | A | 10/1977 | Herd et al. |
| 4,063,602 | A | 12/1977 | Howell et al. |
| 4,087,097 | A | 5/1978 | Bossens et al. |
| 4,091,881 | A | 5/1978 | Maus |
| 4,098,341 | A | 7/1978 | Lewis |
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,216,835 | A | 8/1980 | Nelson |
| 4,222,590 | A | 9/1980 | Regan |
| 4,249,600 | A | 2/1981 | Bailey |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |
| 4,310,058 | A | 1/1982 | Bourgoyne, Jr. |
| 4,312,404 | A | 1/1982 | Morrow |
| 4,313,054 | A | 1/1982 | Martini |
| 4,326,584 | A | 4/1982 | Watkins |

4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,497,592 A 2/1985 Lawson
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Littlejohn et al.
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey et al.
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,865,137 A 9/1989 Bailey et al.
4,882,830 A 11/1989 Cartensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey et al.
5,040,600 A 8/1991 Bailey et al.
5,048,621 A 9/1991 Bailey et al.
5,062,450 A 11/1991 Bailey et al.
5,062,479 A 11/1991 Bailey et al.
5,072,795 A 12/1991 Delgado et al.
5,076,364 A 12/1991 Hale et al.
5,082,020 A 1/1992 Bailey et al.
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey et al.
5,431,220 A 7/1995 Lennon et al.
5,443,129 A 8/1995 Bailey et al.
5,495,872 A 3/1996 Gallagher et al.
5,529,093 A 6/1996 Gallagher et al.
5,588,491 A 12/1996 Brugman et al.
5,607,019 A 3/1997 Kent
5,647,444 A 7/1997 Williams
5,657,820 A 8/1997 Bailey et al.
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.

5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,017,168 A 1/2000 Fraser, Jr. et al.
6,036,192 A 3/2000 Dietle et al.
6,076,606 A 6/2000 Bailey et al.
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey et al.
6,120,036 A 9/2000 Kalsi et al.
6,129,152 A 10/2000 Hosie et al.
6,138,774 A 10/2000 Bourgoyne, Jr. et al.
6,170,576 B1 1/2001 Brunnert et al.
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann et al.
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,354,385 B1 3/2002 Ford et al.
6,375,895 B1 4/2002 Daemen
6,382,634 B1 5/2002 Dietle et al.
6,386,291 B1 5/2002 Short et al.
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge et al.
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,913,092 B2 7/2005 Bourgoyne et al.
6,945,330 B2 9/2005 Wilson et al.
7,004,444 B2 2/2006 Kinder
7,007,913 B2 3/2006 Kinder
7,011,167 B2 3/2006 Ebner et al.
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne
7,165,610 B2 1/2007 Hopper
7,174,956 B2 2/2007 Williams et al.
7,178,600 B2 2/2007 Luke et al.
7,191,840 B2 3/2007 Pietras et al.
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bourgoyne et al.
7,278,494 B2 10/2007 Williams
7,278,496 B2 10/2007 Leuchtenberg
7,296,628 B2 11/2007 Robichaux et al.
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.
7,367,411 B2 5/2008 Leuchtenberg
7,377,334 B2 5/2008 May
7,380,590 B2 6/2008 Hughes
7,380,591 B2 6/2008 Williams
7,380,610 B2 6/2008 Williams
7,383,876 B2 6/2008 Gray et al.
7,389,183 B2 6/2008 Gray
7,392,860 B2 7/2008 Johnston
7,413,018 B2 8/2008 Hosie et al.
7,416,021 B2 8/2008 Williams
7,416,226 B2 8/2008 Williams
7,448,454 B2 11/2008 Bourgoyne et al.
7,451,809 B2 11/2008 Noske et al.
7,475,732 B2 1/2009 Hosie et al.
7,487,837 B2 2/2009 Bailey et al.
7,513,300 B2 4/2009 Pietras et al.
7,559,359 B2 7/2009 Williams
7,635,034 B2 12/2009 Williams
7,654,325 B2 2/2010 Giroux et al.
7,669,649 B2 3/2010 Williams
2003/0056992 A1 3/2003 Looper
2003/0164276 A1 9/2003 Snider et al.
2003/0173073 A1 9/2003 Snider et al.
2004/0017190 A1 1/2004 McDearmon et al.
2005/0028972 A1 2/2005 Wilson et al.
2005/0133266 A1* 6/2005 May et al. ..... 175/57
2005/0151107 A1 7/2005 Shu
2005/0211429 A1 9/2005 Gray et al.
2005/0241833 A1 11/2005 Bailey et al.
2006/0037782 A1 2/2006 Martin-Marshall
2006/0108119 A1 5/2006 Bailey et al.
2006/0144622 A1 7/2006 Bailey et al.
2006/0157282 A1 7/2006 Tilton et al.
2006/0191716 A1 8/2006 Humphreys
2007/0051512 A1 3/2007 Markel et al.
2007/0095540 A1 5/2007 Kozicz et al.
2007/0163784 A1 7/2007 Bailey et al.
2008/0035377 A1 2/2008 Sullivan et al.
2008/0041149 A1 2/2008 Leuchtenberg
2008/0047449 A1 2/2008 Wilson et al.
2008/0059073 A1 3/2008 Giroux et al.
2008/0060846 A1 3/2008 Belcher et al.
2008/0105462 A1 5/2008 May et al.
2008/0110637 A1 5/2008 Snider et al.
2008/0169107 A1 7/2008 Redlinger et al.
2008/0210471 A1 9/2008 Bailey et al.
2008/0236819 A1 10/2008 Foster et al.
2008/0245531 A1 10/2008 Noske et al.
2008/0296016 A1 12/2008 Hughes et al.

| | | | |
|---|---|---|---|
| 2009/0025930 | A1 | 1/2009 | Iblings et al. |
| 2009/0057012 | A1 | 3/2009 | Williams |
| 2009/0057020 | A1 | 3/2009 | Williams |
| 2009/0057021 | A1 | 3/2009 | Williams |
| 2009/0057022 | A1 | 3/2009 | Williams |
| 2009/0057024 | A1 | 3/2009 | Williams |
| 2009/0057025 | A1 | 3/2009 | Williams |
| 2009/0057027 | A1 | 3/2009 | Williams |
| 2009/0057029 | A1 | 3/2009 | Wiiliams |
| 2009/0101351 | A1 | 4/2009 | Hannegan et al. |
| 2009/0101411 | A1 | 4/2009 | Hannegan et al. |
| 2009/0139724 | A1 | 6/2009 | Gray et al. |
| 2009/0152006 | A1 | 6/2009 | Leduc et al. |
| 2009/0166046 | A1 | 7/2009 | Edvardsen et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |

FOREIGN PATENT DOCUMENTS

| | | | |
|---|---|---|---|
| CA | 2447196 | A1 | 4/2004 |
| EP | 0290250 | A2 | 11/1988 |
| EP | 0290250 | A3 | 11/1988 |
| EP | 0267140 | B1 | 3/1993 |
| EP | 1375817 | A1 | 1/2004 |
| EP | 1519003 | A1 | 3/2005 |
| EP | 1659260 | A2 | 5/2006 |
| GB | 2019921 | A | 11/1979 |
| GB | 2067235 | A | 7/1981 |
| GB | 2394738 | A | 5/2004 |
| GB | 2394741 | | 5/2004 |
| GB | 2449010 | A | 8/2007 |
| WO | WO 99/45228 | A1 | 9/1999 |
| WO | WO 99/50524 | A2 | 10/1999 |
| WO | WO 99/50524 | A3 | 10/1999 |
| WO | WO 99/51852 | A1 | 10/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |

OTHER PUBLICATIONS

Cameron, Cameron HC Collet Connector, Brochure WR4701, Mar. 1996 © 1996 Cooper Cameron Corporation, Cameron Division (12 pages).

Gault, Allen, Riserless drilling: circumventing the size/cost cycle in deepwater—Conoco, Hydril project seek enabling technologies to drill in deepest water depths economically, Offshore Drilling Technology, May 1996, pp. 49, 50, 52, 53, 54 & 55 (6 pages).

Williams Tool Company, Inc. website home page, Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications—Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact Us (2 pages).

Furlow, William, Shallow flow diverter JIP spurred by deepwater washouts, Offshore—World Trends and Technology for Offshore Oil and Gas Operations, Mar. 1998, cover page and pp. 2 & 90 (3 pages).

Williams Tool Company, Inc., Rotating Control Heads and Strippers for Air, Gas, Mud, and Geothermal Drilling Worldwide—Sales Rental Service, © 1988 Williams Tool Co., Inc. (19 pages).

Williams Tool Company, Inc., Rotating Control Heads and Strippers for Air, Gas, Mud, Geothermal and Horizontal Drilling, Catalog #2002, © 1991 Williams Tool Co., Inc. (19 pages).

Fig. 14 Floating Piston Drilling Choke Design, printed May 1997 (1 page).

Stone, Charles R. "Rick" et al., Blowout Preventer Testing for Underbalanced Drilling, Sep. 1997, Signa Engineering Corp., Houston, Texas (24 pages).

Williams Tool Company, Inc., Instructions—Assemble & Disassemble Model 9000 Bearing Assembly (cover page and 27 numbered pages).

Williams Tool Company, Inc., Rotating Control Heads—Making Drilling Safer While Reducing Costs Since 1968, © 1989 Williams Tool Co., Inc. (4 pages).

Williams Tool Company, Inc., International—Model 7000 Rotating Control Head, © 1991 Williams Tool Co., Inc. (4 pages).

Williams Tool Company, Inc., Williams Rotating Control Heads—Reduce Costs—Increase Safety—Reduce Environmental Impact, © 1995 Williams Tool Co., Inc. (4 pages).

Williams Tool Company, Inc., Sales-Rental-Service—Williams Rotating Control Heads and Strippers for Air, Gas, Mud, and Geothermal Drilling, © 1982 Williams Tool Co., Inc. (7 pages).

Williams Tool Company, Inc., Rotating Control Heas and Strippers for Air, Gas, Mud and Geothermal Drilling, Catalog #2001, © 1991 Williams Tool Co., Inc. (19 pages).

Hannegan, Don, Williams Tool Co., Inc., Communicating—The When? and Why? of Rotating Control Head Usage, The Brief Jan. 1996 issue, The Brief's Guest Columnists, Dec. 13, 1995 Article Index No. 20, pp. 26-27, © 1996 Murphy Publishing, Inc. (2 pages).

Bourgoyne, Jr., Adam T., Rotating Control head applications increasing, Oil & Gas Journal, Technology, Reprinted from the Oct. 9, 1995 edition of Oil & Gas Journal, © 1995 PennWell Publishing Company (4 pages).

Grant Oil Tool Company, Rotating Drilling Head for Air, Gas or Mud Drilling, 1966-1967 Composite Catalog, p. 2041 (1 page).

Grant Oil Tool Company, Rotating Drilling Head Models 7068, 7368, 8068 (Patented)—Equally Effective with Air, Gas, or Mud Circulation Media, 1976-1977 Composite Catalog, pp. 2691-2693 (3 pages).

Bourgoyne, Darryl A. et al., A Subsea Rotating Control Head for Riserless Drilling Applications, 1998 International Association of Drilling Contractors International Deep Water Well Control Conference held in Houston, Texas, Aug. 26-27, 1998, pp. D-86 to D-99 © 1998 (14 pages).

Hannegan, Don, Applications widening for rotating control heads, Drilling Contractor, Jul. 1996, cover page and pp. 5, 17, & 19, vol. 52, No. 4, Drilling Contractor Publications Inc., Houston, Texas (4 pages).

Hughes Tool Company, Hughes Offshore 1986-87 Subsea Systems and Equipment, Hughes Drilling Equipment Composite Catalog, pp. 2986-3004 (19 pages).

Williams Tool Company, Inc., Technical Specifications Model—The Model 7100 (3 pages).

Williams Tool Company, Inc. website, Underbalanced Drilling (UBD)—The Attraction of UBD (2 pages).

Williams Tool Company, Inc. website, Applications—Where using a Williams rotating control head while drilling is a plus (2 pages).

Williams Tool Company, Inc. website, Model 7100 (3 pages).

Hughes Tool Company, Hughes Offshore 1982/1983 Regan Products, Hughes Offshore Composite Catalog, Regan Products, cover page, 4308-20, 4308-27 thru 4308-43, and end sheet, (see p. 4308-36 Type KFDR Diverter) © 1982 Hughes Offshore (20 pages).

Coflexip International, Brochure, p. 1: Coflexip Sales Offices, p. 2: The Flexible Steel Pipe for Drilling and Service Applications, p. 3: New 5" I.D.—General Drilling Flexible, p. 4: Applications, and p. 5—Illustration (5 pages).

Baker, Ron, A Primer of Oilwell Drilling, 4$^{th}$ Edition, 3 cover pages and pp. 42-49, Petroleum Extension Service of the University of Texas at Austin, Austin, Texas © 1979 The University of Texas at Austin (11 pages).

Dutch Enterprises Inc., Lock down Lubricator System—"Safety with Savings", pp. D-3 thru D-18 (16 pages).

Hydril Company website, Hydril GL® Annual Blowout Preventers (Patented), printed Aug. 28, 1998, pp. D-20 & D-21, corresponding website http://www.hydril.com/ns/Pbro/bop8.htm, (see Roche patents above) (2 pages).

Hydril Company website, About Pressure Control Products, printed Aug. 28, 1998, pp. D-29 thru D-47, corresponding website http://www.hydril.com/ns/Pbro/bop8.htm, (the GH Gas Handler Series Product is listed), © 1996 Hydril Company (19 pages).
NL Industries, Inc., Shaffer Type 79 Rotating Blowout Preventers—NL Rig Equipment/NL Industries, Inc., pp. D-49 thru D-54, Brochure NLS 4849-580 (6 pages).
Shaffer®, A Varco® Company, Shaffer® Pressure Control, Spherical® Blowout Preventers, Shaffer's NXT BOP, Other Products, cover page and pp. 1562-1568 (8 pages).
Leach, Colin P. et al., Avoiding Explosive Unloading of Gas in a Deep Water Riser when SOBM is in Use, 1998 (describes an application for the Hydril GH 21-2000 Gas Handler shown in Figure 1) (9 pages).
Lopes, Clovis A. et al., Feasibility Study of a Dual Density Mud System for Deepwater Drilling Operations, 1997 Offshore Technology Conference held in Houston, Texas, May 5-8, 1997, Paper No. OTC 8465; pp. 257-266 © 1997 Offshore Technology Conference (10 pages).
Offshore Drilling with Light-weight Fluids, Joint Industry Project Presentation, Apr. 1998, pp. C-3 thru C-11 (9 pages).
Nakagawa, Edson Y. et al., Application of Aerated-Fluid Drilling in Deepwater, 1999 SPE/IADC Drilling Conference held in Amsterdam, Holland, Mar. 9-11, 1999, Paper SPE/IADC 52787, Presented by Don Hannegan, P.E., SPE © 1999 SPE/IADC Drilling Conference (5 pages).
Inter-Tech Drilling Solutions Ltd., Inter-Tech Drilling Solutions Ltd.'s RBOP™ means Safety and Experience for Underbalanced Drilling, Inter-Tech Drilling Solutions Ltd./Big D Rentals & Sales (1981) Ltd. (2 pages).
Shaffer®, A Varco® Company, Pressure Control While Drilling, © Varco Shaffer, Inc. (2 pages).
Shaffer®, A Varco® Company, Field Exposure (As of Aug. 1998) (1 page).
Rotating Spherical BOP (1 page).
Nakagawa, Edson Yoshihito et al., JIP's Work Brightens Outlook for UBD in Deep Waters, The American Oil & Gas Reporter®, Apr. 1999, cover page and pp. 53, 56, 58-61 & 63 (8 pages).
Seal-Tech—Division Folsom Metal Products, 1500 PSI Rotating Blowout Preventer, (3 pages).
Techcorp Industries International, Inc., RPM System 3000™ Rotating Blowout Preventer—"Setting a new standard in Well Control," (4 pages).
Williams Tool Company, Inc., RiserCap™ Materials Presented at the 1999 LSU/MMS/IADC Well Control Workshop, Mar. 24-25, 1999, Session 2, Presentation 12 © 1999 Williams Tool Company, Inc. (14 pages).
Smith, John Rogers, The 1999 LSU/MMS Well Control Workshop: An overview, World Oil®, Jun. 1999, cover page and pp. 4, 41-42, & 44-45, Gulf Publishing Company, Houston, Texas (6 pages).
Nessa, Dag Oluf et al., Offshore underbalanced drilling system could revive field developments, World Oil®, Oct. 1997, vol. 218, No. 10, cover page and pp. 3, 83-84, 86, & 88, Gulf Publishing Company, Houston, Texas, © 1997 Gulf Publishing Company (6 pages).
Nessa, Dag Oluf et al., Offshore underbalanced drilling system could revive field developments, World Oil®, Jul. 1997, vol. 218, No. 7, cover page and pp. 3, 61-64, & 66, Gulf Publishing Company, Houston, Texas, © 1997 Gulf Publishing Company (7 pages).
PCT International Search Report, International Application No. PCT/US99/06695, completion date May 27, 1999, mailing date Jun. 14, 1999 (4 pages).
PCT International Search Report, International Application No. PCT/GB00/00731, completion date Jun. 16, 2000, mailing date Jun. 27, 2000 (3 pages).
National Academy of Sciences—National Research Council, Design of a Deep Ocean Drilling Ship, cover page and pp. 114-121 (9 pages).
Cress, L.A. et al., History and Development of a Rotating Preventer, 1992 IADC/SPE Drilling Conference held in New Orleans, Louisiana, Feb. 18-21, 1992, Paper IADC/SPE 23931, pp. 757-773 (17 pages).
Rehm, Bill, Practical Underbalanced Drilling and Workover, 2002, cover page, title page, copyright page, and pp. 6-6, 11-2, 11-3, G-9, and G-10, Petroleum Extension Service—The University of Texas at Austin, © 2002 The University of Texas at Austin (8 pages).
Williams Tool Company Inc., Risercap™: Rotating Control Head System for Floating Drilling Rig Applications, © 1999 Williams Tool Company, Inc. (4 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, © 2001 Society of Petroleum Engineers, Inc. (11 pages).
Santos, Helio et al., Drilling and Aerated Fluid from a Floating Unit. Part 1: Planning, Equipment, Tests, and Rig Modifications, 2001 SPE/IADC Drilling Conference held in Amsterdam, The Netherlands, Feb. 27, 2001 to Mar. 1, 2001, Paper SPE/IADC 67748, © 2001 SPE/IADC Drilling Conference (8 pages).
Nakagawa, E. Y. et al., Planning of Deepwater Drilling Operations with Aerated Fluids, 1999 SPE Asia Pacific Oil and Gas Conference and Exhibition held in Jakarta, Indonesia, Apr. 20-22, 1999, Paper SPE 54283, (© 1999 Society of Petroleum Engineers (7 pages).
Nakagawa, E. Y. et al., Implementing the Light-Weight Fluids Drilling Technology in Deepwater Scenarios, 1999 LSU/MMS Well Control Workshop Mar. 24-25, 1999 (12 pages).
Stewart & Stevenson website, Press Releases: Stewart & Stevenson introduces First Dual Gradient Riser, Aug. 31, 2000, printed Oct. 7, 2002, corresponding website http://www.ssss.com/ssss/20000831.asp (2 pages).
Williams Tool Company Inc., Williams Tool Company Introduces the . . . Virtual Riser™, © 1998 Williams Tool Company, Inc. (4 pages).
The University of Texas At Austin website, Petroleum Extension Service, PETEX Publications, printed Nov. 14, 2003, corresponding website http://www.utexas.edu/cee/petex/pubs/drilling.html, (last modified Dec. 6, 2002) (12 pages).
SPE International, BG in the Caspian region, SPE Review, Magazine of the Aberdeen and London Sections of the Society of Petroleum Engineers, May 2003, Issue 164 (3 pages).
Impact Fluid Solutions, Field Cases as of Mar. 3, 2003, printed Sep. 5, 2003, corresponding website http://www.impact-os.com/fluid_solutions/Field_Cases.htm (6 pages).
Maurer Technology Inc, Determine in the Safe Application of Underbalanced Drilling Technologies in Marine Environments—Technical Proposal, Jun. 17, 2002, Proposal TP02-10 JIP (13 pages).
Colbert, John W., John W. Colbert, P.E. Vice President Engineering Biographical Data, Signa Engineering Corp. (2 pages)
Parker Drilling website, Technical Training Courses, printed Sep. 5, 2003, corresponding website http://www.parkerdrilling.com/news/tech.html (5 pages).
Drilling equipment: Improvements from data recording to slim hole, Drilling Contractor, Mar./Apr. 2000, pp. 30-32, Drilling Contractor Publications, Inc., Houston, Texas (3 pages).
Drilling conference promises to be informative, Drilling Contractor, Jan./Feb. 2002, p. 10 (1 page).
OGCI, Inc. website, Underbalanced and Air Drilling, printed Sep. 5, 2003, corresponding website http://www.ogci.com/course_info.asp?counselD=410 (2 pages).
Society of Professional Engineers website, 2003 SPE Calendar, printed Sep. 5, 2003, cache of corresponding website http://www.spe.org/spe/cda/views/events/eventMaster/0,1470,1648_2194_632303.00.html, © 2001 Society of Professional Engineers (2 pages).
Schlumberger Limited website, Oilfield Glossary—reverse-circulating valve, corresponding website http://www.glossary.oilfield.slb.com/Display.cfm?Term=reverse-circulating%20valve, © 2003 Schlumberger Limited (1 page).
Murphy, Ross D. et al., A drilling contractor's view of underbalanced drilling, WorldOil® Magazine, May 2002, vol. 223, No. 5, Feature Article (9 pages).
Weatherford, Weatherford UnderBalanced Services—General Underbalance Presentation to the DTI, © 2002 Weatherford (71 pages).
Rach, Nina M., Underbalanced near-balanced drilling are possible offshore, Oil & Gas Journal, Dec. 1, 2003, pp. 39-44 (6 pages).

Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages).
Hannegan, D.M. et al., Deepwater Drilling with Lightweight Fluids—Essential Equipment Required, SPE/IADC Drilling Conference held in Amsterdam, The Netherlands, Feb. 27, 2001 to Mar. 1, 2001, Paper SPE/IADC 67708, © 2001 SPE/IADC Drilling Conference (6 pages).
Hannegan, Don M., Underbalanced Operations Continue Offshore Movement, SPE/IcoTA Coiled Tubing Roundtable held in Houston, Texas, Mar. 7-8, 2001, Paper SPE 68491, © 2001 Society of Petroleum Engineers, Inc. (3 pages).
Hannegan, D., Underbalanced Drilling—Perceptions and Realities of Today's Technology in Offshore Applications, IADC/SPE Drilling Conference held in Dallas, Texas, Feb. 26-28, 2002, Paper IADC/SPE 74448, © 2002 IADC/SPE Drilling Conference (9 pages).
Hannegan, Don M. et al., Well Control Considerations—Offshore Applications of Underbalanced Drilling Technology, SPE/IADC Drilling Conference held in Amsterdam, The Netherlands, Feb. 19-21, 2003, Paper SPE/IADC 79854, © 2003 SPE/IADC Drilling Conference (14 pages).
Bybee, Karen, Offshore Applications of Underbalanced—Drilling Technology, Journal of Petroleum Technology, Jan. 2004, cover page and pp. 51-52 (3 pages).
Bourgoyne, Darryl A. et al., A Subsea Rotating Control Head for Riserless Drilling Applications, 1998 IADC International Deep Water Well Control Conference held in Houston, Texas, Aug. 26-27, 1998 (see document T) © 1998 (14 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, (see document BBB) © Society of Professional Engineers Inc. (11 pages).
Furlow, William, Shell's seafloor pump, solids removal key to ultra-deep, dual-gradient drilling—Skid ready for commercialization, Offshore Magazine, World Trends and Technology for Offshore Oil and Gas Operations, Jun. 2001, cover page, and pp. 4, 54, 2 unnumbered pages, & 106, International Edition, vol. 61, No. 6, PennWell, © 2001 PennWell (6 pages).
Rowden, Michael V., Advances in riserless drilling pushing the deepwater surface string envelope—Alternative to seawater, CaCl2 sweeps, Offshore Magazine, World Trends and Technology for Offshore Oil and Gas Operations, Jun. 2001, cover page, pp. 4, 56, 58, and 106, International Edition, vol. 61, No. 6, PennWell, © 2001 PennWell (5 pages).
Boye, John, Multi Purpose Intervention Vessel Presentation, M.O.S.T. Multi Operational Service Tankers, Jan. 2004, © 2003 Weatherford (43 pages).
GB Search Report, International Application No. GB 0324939.8, Jan. 21, 2004 (1 page).
Terwogt, Jan; Maekiaho, Leo; Si-Boon, Wee (Shell Malaysia Exploration and Production); Jenkins, James; Gedge, Ben (Weatherford); "Pressured Mud Cap Drilling—Advanced Well Control of Subsea Wells"; Petromin Subse Asia Conference, Sep. 20-21, 2004, Kuala Lumpur, Malaysia (8 pages).
PCT International Search Report, International Application No. PCT/EP2004/052167, date of completion Nov. 25, 2004, date of mailing Dec. 2, 2004 (4 pages).
PCT Written Opinion of the International Searching Authority, International Application No. PCT/EP2004/052167 (6 pages).
Supplementary European Search Report, Application No. EP 99908371, date of completion Oct. 22, 2004 (3 pages).
Vetco Offshore Industries, Inc., General Catalog 1970-1971, Vetco® Subsea Systems, cover page, and p. 4799-4800, 4816-4818 (see numbered p. 4816 for "patented" Vetco H-4 connectors) (6 pages).
Vetco Offshore, Inc., General Catalog 1972-1973, Subsea Systems, cover page, company page and pp. 4498, 4509-4510 (5 pages).
Vetco Offshore, Inc., General Catalog 1974-1975, cover page, company page and pp. 5160, 5178-5179 (5 pages).
Vetco Offshore, Inc., General Catalog 1976-1977, Subsea Drilling and Completion Systems, cover page and pp. 5862-5863, and 5885 (4 pages).
Vetco, General Catalog 1982-1983, cover page and pp. 8454-8455, 8479 (4 pages).
Shaffer, A Varco Company website, Pressure Control While Drilling System, printed Jun. 21, 2004, corresponding website http://www.tulsaequip.com (2 pages).
Precision Drilling Corporation, Performance Drilling by Precision Drilling. A Smart Equation, © 2002 Precision Drilling Corporation (12 pages).
Weatherford, RPM System 3000™ Rotating Blowout Preventer—Setting a new standard in Well Control, Weatherford Underbalanced Systems, Brochure #333.01 © 2002-2005 Weatherford (4 pages).
Hannegan, Don, Managed Pressure Drilling in Marine Environments, Drilling Engineering Association Workshop, Moody Gardens, Galveston, Texas, Jun. 22-23, 2004, © 2004 Weatherford (28 pages).
Smith International, Inc., Hold™ 2500 RCD Rotating Control Device web page and brochure, printed Oct. 27, 2004, corresponding website http://www.smith.com/hold2500, Smith Services, A Business Unit of Smith International, Inc. © 2004 Smith International, Inc. (5 pages).
Rehm, Bill, Practical Underbalanced Drilling and Workover, 2002, cover page, title page, copyright page, and pp. 6-1 to 6-9, and 7-1 to 7-9, Petroleum Extension Service—The University of Texas at Austin, © 2002 The University of Texas at Austin (21 pages).
Terwogt, J.H. et al., Pressured Mud Cap Drilling from a Semi-Submersible Drilling Rig, SPE/IADC Drilling Conference held in Amsterdam, The Netherlands, Feb. 23-25, 2005, Paper SPE/IADC 92294, © 2005 SPE/IADC Drilling Conference (6 pages).
Tangedahl, M.J., et al., Rotating Preventers: Technology for better well control, World Oil, Oct. 1992, pp. 63-64 & 66, vol. 213, No. 10, Gulf Publishing Company, Houston, Texas (3 pages).
Partial European Search Report, Application No. EP 05 27 0083, completed Feb. 8, 2006 (5 pages).
Netherlands Search Report, Application No. NL 1026044, date completed Dec. 14, 2005 (3 pages).
International Search Report, Application No. PCT/GB 00/00731 (corresponding to U.S. 6,470,975), completed Jun. 16, 2000 (2 pages).
GB Examination Report, Application No. GB0324939.8 (corresponding to U.S. 6,470,975), Mar. 21, 2006 (6 pages).
GB Examination Report, Application No. GB0324939.8 (corresponding to U.S. 6,470,975), Jan. 22, 2004 (3 pages).
MicroPatent® Family Lookup, U.S. Pub. No. 2003/0106712, printed Jun. 15, 2006 (5 pages).
MicroPatent® Family Lookup, U.S. 6,470,975, printed Jun. 15, 2006 (5 pages).
AU Examination Report, Application No. 28183/00 (corresponding to U.S. 6,470,975), Sep. 9, 2002 (1 page).
NO Examination Report, Application No. 20013953 (corresponding to U.S. Patent No. 6,470,975), first page English translation, Apr. 29, 2003 (3 pages).
Nessa, Dag Oluf et al., Offshore underbalanced drilling system could revive field developments, World Oil®, Jul. 1997, vol. 218, No. 7, cover page and pp. 3, 61-64 and 66 (Part 1), and World Oil®, Oct. 1997, vol. 218, No. 10, cover page and pp. 3, 83-84, 86 and 88 (Part 2) (see 5A, 5G above and 5I below), Gulf Publishing Company, Houston, Texas, © 1997 Gulf Publishing Company (13 pages).
International Search Report, Application No. PCT/GB 00/00731 (corresponding to U.S. 6, 470,975), completed Jun. 16, 2000 (4 pages).
International Preliminary Examination Report, Application No. PCT/GB 00/00731 (corresponding to U.S. 6,470,975), completion Dec. 14, 2000 (7 pages).
NL Examination Report, Application WO 00/52299 (corresponding to this U.S. Appl. No. 10/281,534), completed Dec. 19, 2003 (3 pages).
AU Examination Report, Application No. 28181/00 (corresponding to U.S. 6,263,982), Sep. 6, 2002 (1 pages).
EU Examination Report, Application No. WO 00/906522.8-2315 (corresponding to U.S. 6,263,982), Nov. 29, 2004 (4 pages).

NO Examination Report, Application No. 20013952 (corresponding to U.S. 6,263,982), two pages English translation, Jul. 22, 2005 (4 pages).
International Preliminary Examination Report, Application No. PCT/GB00/00726 (corresponding to U.S. 6,263,982), completed Jun. 26, 2001 (10 pages).
Written Opinion, International Preliminary Examining Authority, Application No. PCT/GB00/00726 (corresponding to U.S. 6,263,982), mailed Dec. 18, 2000 (7 pages).
International Search Report, Application No. PCT/GB00/00726 (corresponding to U.S. 6,263,982), completed May 3, 2000 (3 pages).
AU Examination Report, Application No. 27822/99 (corresponding to U.S. 6,138,774), Oct. 15, 2001 (1 page).
Supplementary European Search Report, Application No. 99908371.0-1266-US9903888 (corresponding to U.S. 6,138,774), completed Oct. 22, 2004 (3 pages).
NO Examination Report, Application No. 20003950 (corresponding to U.S. 6,138,774), one page English translation, Nov. 1, 2004 (3 pages).
International Search Report, Application No. PCT/US99/03888 (corresponding to U.S. 6,138,774), completed Jun. 24, 1999 (6 pages).
Written Opinion, International Preliminary Examining Authority, Application No. PCT/US99/03888 (corresponding to U.S. 6,138,744), mailed Dec. 21, 1999 (5 pages).
International Preliminary Examination Report, Application No. PCT/US99/03888 (corresponding to U.S. 6,138,774), completed May 4, 2000 (15 pages).
EU Examination Report, Application No. 05270083.8-2315 (corresponding to U.S. Pub. No. 2006/0108119 A1, now US 7,487,837 B2 published May 25, 2006 , May 10, 2006 (11 pages).
Tangedahl, Michael J. et al., Rotating Preventers: Technology for better well control, World Oil®, Oct. 1992, vol. 213, No. 10, pp. 63-64 and 66, Gulf Publishing Company, Houston, Texas, © 1997 Gulf Publishing Company (3 pages).
GB Search Report, Application No. GB 0325423.2, searched Jan. 30, 2004 (one page).
GB Examination Report, Application No. GB 0325423.2, Jun. 30, 2005 (4 pages).
Dietle, Lannie L. et al., Kalsi Seals Handbook, Doc. 2137 Revision 1 (see in particular Forward p. ii for "Patent Rights"; Appendix A-6 for Kalsi seal part No. 381-6-* and A-10 for Kalsi seal part No. 432-32-* as discussed in U.S. Appl. No. 11/366,078, now US 2006/0144622 A1 at å 70 and 71), Kalsi Engineering, Inc, Sugar Land, Texas © 1992-2005 Kalsi Engineering, Inc. (167 pages).
Fig. 10 and discussion in U.S. Appl. No. 11/366,078 application of Background of Invention (2 pages) (see US Patent Publication No. US2006-0144622 Al published on Jul. 6, 2006).
Partial European search report R.46 EPC dated Jun. 27, 2007 for European Patent Application EP07103416.09-2315 corresponding to above U.S. Appl. No. 11/366,078, now US 2006/0144622 A1 (5 pages).
Extended European search report R.44 EPC dated Oct. 9, 2007 for European Patent Application 07103416.9-2315 corresponding to above U.S. Appl. No. 11/366,078, now US 2006/0144622 A1 (8 pages).
U.S. Appl. No. 60/079,641, Mudlift System for Deep Water Drilling, filed Mar. 27, 1998, abandoned, but priority claimed in above US 6,230,824 B1 and 6,102,673 and PCT WO99/50524 (54 pages).
U.S. Appl. No. 60/122,530, Concepts for the Application of Rotating Control Head Technology to Deepwater Drilling Operations, filed Mar. 2, 1999, abandoned, but priority claimed in above US 6,470,975 B1 (54 pages).
PCT/GB2008/050239 (corresponding to US2008/0210471 A1) Annex to Form PCT/ISA/206 Communication Relating to the Results of the Partial International Search dated Aug. 26, 2008 (4 pages).
PCT/GB2008/050239 (corresponding to US2008/0210471 A1) International Search Report and Written Opinion of the International Searching Authority (16 pages).
Vetco Gray Product Information CDE-PI-0007 dated Mar. 1999 for 59.0" Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexical OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages).
Turck Works Industrial Automation; Factor 1 Sensing for Metal Detection (2 pages) (no date).
Balluff Sensors Worldwide; Object Dectection Catalog Aug. 2009—Industive Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
AC 2-Wire Tubular Sensors, Balluff product catalog pp. 1.109-1.120 (12 pages) (no date).
DC 2-Wire Tubular Sensors, Balluff product catalog pp. 1.125-1.136 (12 pages) (no date).
Analog Inductive Sensors, Balluff product catalog pp. 1.157-1.170 (14 pages) (no date).
DC 3-/4-Wire Inductive Sensors, Balluff product catalog pp. 1.72-1.92 (21 pages).

Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 2009 M-I, LLC © 1996-2010 Space Age Control, Inc., printed Feb. 18, 2010 (6 pages).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Partial European Search Report (R.64 EPC) dated Mar. 22, 2010 for European Application corresponding to U.S. Appl. No. 11/975,946 published as US 2009-0101411 A1 (6 pages).
Canadian Intellectual Property Office Office Action dated Feb. 3, 2010, Application No. 2,641,238 entitled "Fluid Drilling Equipment" for Canadian Application corresponding to U.S. Appl. No. 11/975,946 published as US 2009-0101411 A1 (2 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6.
Hannegan, Don M.; Managed Pressure Drilling—A New Way of Looking at Drilling Hydraulics—Overcoming Conventional Drilling Challenges; SPE 2006-2007 Distinguished Lecturer Series presntation (29 pages); see all but particularly see Figs. 14-20.
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Action dated Feb. 3, 2010, Application No. 2,641,238 entitled "Fluid Drilling Equipment" for Canadian Application corresponding to U.S. Appl. No. 11/945,946, published as US-2009-0101411 on Apr. 23, 2009 (2 pages).
Canadian Intellectual Property Office Action dated Oct. 25, 2011, Application No. 2,641,238 entitled "Fluid Drilling Equipment" for Canadian Application corresponding to U.S. Appl. No. 11/945,946, published as US-2009-0101411 on Apr. 23, 2009 (4 pages).
Amendment/Remarks After Examiner's Report filed in the Canadian Patent Office in response to 7S above on Apr. 25, 2012 (17 pages).
Voluntary Amendment filed in the Canadian Patent Office on Apr. 30, 2012 in Application No. 2,641,238 entitled "Fluid Drilling Equipment" for Canadian Application corresponding to U.S. Appl. No. 11/945,946, published as US-2009-0101411 on Apr. 23, 2009 (21 pages).
Response to the European Search Report of NPL "7Q" filed in the European Patent Office on Oct. 6, 2011, for European Application No. 08166658.8 corresponding to U.S. Appl. No. 11/945,946, published as US-2009-0101411 on Apr. 23, 2009 (5 pages).

* cited by examiner 130
124
154
156
158
162
126
125
6A
128
136
14
132
160
142
140
163
138
HS
6
134
137
10C
120
131
122
146
144
148
150
152
D4
D3
H5

LOW PROFILE ROTATING CONTROL DEVICE

CROSS-REFERENCE TO RELATED APPLICATIONS

N/A

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to the field of fluid drilling equipment, and in particular to rotating control devices to be used in the field of fluid drilling equipment.

2. Description of the Related Art

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

These improved techniques present a need for pressure management devices, such as rotating control heads or devices (referred to as RCDs). RCDs, such as proposed in U.S. Pat. No. 5,662,181, have provided a dependable seal in the annular space between a rotating tubular and the casing or a marine riser for purposes of controlling the pressure or fluid flow to the surface while drilling operations are conducted. Typically, a member of the RCD is designed to rotate with the tubular along with an internal sealing element(s) or seal(s) enabled by bearings. The seal of the RCD permits the tubular to move axially and slidably through the RCD. As best shown in FIG. 3 of the '181 patent, the RCD has its bearings positioned above a lower sealing element or stripper rubber seal, and an upper sealing element or stripper rubber seal is positioned directly and completely above the bearings. The '181 patent proposes positioning the RCD with a housing with a lateral outlet or port with a circular cross section for drilling fluid returns. As shown in FIG. 3 of the '181 patent, the diameter of a circular flange at the end of a circular conduit communicating with the port is substantially smaller than the combined height of the RCD and housing. The term "tubular" as used herein means all forms of drill pipe, tubing, casing, riser, drill collars, liners, and other tubulars for drilling operations as are understood in the art.

U.S. Pat. No. 6,138,774 proposes a pressure housing assembly with a RCD and an adjustable constant pressure regulator positioned at the sea floor over the well head for drilling at least the initial portion of the well with only sea water, and without a marine riser. As shown in FIG. 6 of the '774 patent, the diameters of the circular flanges are substantially smaller than the combined height of the RCD and pressure housing.

U.S. Pat. No. 6,913,092 B2 proposes a seal housing with a RCD positioned above sea level on the upper section of a marine riser to facilitate a mechanically controlled pressurized system that is useful in underbalanced subsea drilling. A remote controlled external disconnect/connect clamp is proposed for hydraulically clamping the bearing and seal assembly of the RCD to the seal housing. As best shown in FIG. 3 of the '092 patent, in one embodiment, the seal housing of the RCD is proposed to contain two lateral conduits extending radially outward to respective T-connectors for the return pressurized drilling fluid flow. As further shown in FIG. 3 of the '092 patent, each diameter of the two lateral conduits extending radially outward are substantially smaller than the combined height of the RCD and seal housing.

U.S. Pat. No. 7,159,669 B2 proposes that the RCD positioned with an internal housing member be self-lubricating. The RCD proposed is similar to the Weatherford-Williams Model 7875 RCD available from Weatherford International of Houston, Tex.

Pub. No. US 2006/0108119 A1 proposes a remotely actuated hydraulic piston latching assembly for latching and sealing a RCD with the upper section of a marine riser or a bell nipple positioned on the riser.

Pub. No. US 2006/0144622 A1 proposes a system and method for cooling a RCD while regulating the pressure on its upper radial seal. Gas, such as air, and liquid, such as oil, are alternatively proposed for use in a heat exchanger in the RCD.

An annular blowout preventers (BOP) has been often used in conventional hydrostatic pressure drilling. As proposed in U.S. Pat. No. 4,626,135, when the BOP's annular seals are closed upon the drill string tubular, fluid is diverted via a lateral outlet or port away from the drill floor. However, drilling must cease because movement of the drill string tubular will damage or destroy the non-rotatable annular seals. During normal operations the BOP's annular seals are open, and drilling mud and cuttings return to the rig through the annular space. For example, the Hydril Company of Houston, Tex. has offered the Compact GK® 7 1/16"—3000 and 5000 psi annular blowout preventers.

Small drilling rigs with short substructure heights have been used to drill shallow wells with conventional drilling techniques as described above. Some small land drilling rigs are even truck mounted. However, smaller drilling rigs and structures are generally not equipped for managed pressure and/or underbalanced drilling because they lack pressure containment or management capability. At the time many such rigs were developed and constructed, managed pressure and/or underbalanced drilling was not used. As a result of their limited substructure height, there is little space left for additional equipment, particularly if the rig already uses a BOP.

As a result of the shortage of drilling rigs created by the high demand for oil and gas, smaller drilling rigs and structures are being used to drill deeper wells. In some locations where such smaller rigs are used, such as in western Canada and parts of the northwestern and southeastern United States, there exist shallow pockets of $H_2S$ (sour gas), methane, and other dangerous gases that can escape to atmosphere immediately beneath the drill rig floor during drilling and/or workover operations. Several blowouts have occurred in drilling and/or workovers in such conditions. Even trace amounts of such escaping gases create health, safety, and environmental (HSE) hazards, as they are harmful to humans and detrimental to the environment. There are U.S. and Canadian regulatory restrictions on the maximum amount of exposure workers can have to such gases. For example, the Occupational Safety and Health Administration (OSHA) sets an eight hour daily limit for a worker's exposure to trace amounts of $H_2S$ gas when not wearing a gas mask.

Smaller drilling rigs and structures are also typically not able to drill with compressible fluids, such as air, mist, gas, or foam, because such fluids require pressure containment. There are numerous occasions in which it would be economically desirable for such smaller rigs to drill with compressible fluids. Also, HSE hazards could result without pressure containment, such as airborne debris, sharp sands, and toxins.

As discussed above, RCDs and their housings proposed in the prior art cannot fit on many smaller drilling rigs or structures due to the combined height of the RCDs and their housings, particularly if the rigs or structures already uses a BOP. The RCD's height is a result in part of the RCD's bearings being positioned above the RCD's lower sealing element, the RCD's accommodation, when desired, for an upper sealing element, the means for changing the sealing element(s), the configurations of the housing, the area of the lateral outlet or port in the housing, the thickness of the bottom flange of the housing, and the allowances made for bolts or nuts on the mounting threaded rods positioned with the bottom flange of the housing.

RCDs have also been proposed in U.S. Pat. Nos. 3,128,614; 4,154,448; 4,208,056; 4,304,310; 4,361,185; 4,367,795; 4,441,551; 4,531,580; and 4,531,591. Each of the referenced patents proposes a conduit in communication with a housing port with the port diameter substantially smaller than the height of the respective combined RCD and its housing.

U.S. Pat. No. 4,531,580 proposes a RCD with a body including an upper outer member and a lower inner member. As shown in FIG. 2 of the '580 patent, a pair of bearing assemblies are located between the two members to allow rotation of the upper outer member about the lower inner member.

More recently, manufacturers such as Smith Services and Washington Rotating Control Heads, Inc. have offered their RDH 500® RCD and Series 1400 "SHORTY" rotating control head, respectively. Also, Weatherford International of Houston, Tex. has offered its Model 9000 that has a 500 psi working and static pressure with a 9 inch (22.9 cm) internal diameter of its bearing assembly. Furthermore, International Pub. No. WO 2006/088379 A1 proposes a centralization and running tool (CTR) having a rotary packing housing with a number of seals for radial movement to take up angular deviations of the drill stem. While each of the above referenced RCDs proposes a conduit communicating with a housing port with the port diameter substantially smaller than the height of the respective combined RCD and its housing, some of the references also propose a flange on one end of the conduit. The diameter of the proposed flange is also substantially smaller than the height of the respective combined RCD and its housing.

The above discussed U.S. Pat. Nos. 3,128,614; 4,154,448; 4,208,056; 4,304,310; 4,361,185; 4,367,795; 4,441,551; 4,531,580; 4,531,591; 4,626,135; 5,662,181; 6,138,774; 6,913,092 B2; and 7,159,669 B2; Pub. Nos. U.S. 2006/0108119 A1; and 2006/0144622 A1; and International Pub. No. WO 2006/088379 A1 are incorporated herein by reference for all purposes in their entirety. The '181, '774, '092, and '669 patents and the '119 and '622 patent publications have been assigned to the assignee of the present invention. The '614 patent is assigned on its face to Grant Oil Tool Company. The '310 patent is assigned on its face to Smith International, Inc. of Houston, Tex. The '580 patent is assigned on its face to Cameron Iron Works, Inc. of Houston, Tex. The '591 patent is assigned on its face to Washington Rotating Control Heads. The '135 patent is assigned on its face to the Hydril Company of Houston, Tex. The '379 publication is assigned on its face to AGR Subsea AS of Straume, Norway.

As discussed above, a long felt need exists for a low profile RCD (LP-RCD) system and method for managed pressure drilling and/or underbalanced drilling.

BRIEF SUMMARY OF THE INVENTION

A low profile RCD (LP-RCD) system and method for managed pressure drilling, underbalanced drilling, and for drilling with compressible fluids is disclosed. In several embodiments, the LP-RCD is positioned with a LP-RCD housing, both of which are configured to fit within the limited space available on some rigs, typically on top of a BOP. The lateral outlet or port in the LP-RCD housing for drilling fluid returns may have a flange having a diameter that is substantially the same as the height of the combined LP-RCD and LP-RCD housing. Advantageously, in one embodiment, an annular BOP seal is integral with a RCD housing so as to eliminate an attachment member, thereby resulting in a lower overall height of the combined BOP/RCD and easy access to the annular BOP seal upon removal of the RCD.

The ability to fit a LP-RCD in a limited space enables $H_2S$ and other dangerous gases to be being diverted away from the area immediately beneath the rig floor during drilling operations. The sealing element of the LP-RCD can be advantageously replaced from above, such as through the rotary table of the drilling rig, eliminating the need for physically dangerous and time consuming work under the drill rig floor. The LP-RCD enables smaller rigs with short substructure heights to drill with compressible fluids, such as air, mist, gas, or foam. One embodiment of the LP-RCD allows rotation of the inserted tubular about its longitudinal axis in multiple planes, which is beneficial if there is misalignment with the wellbore or if there are bent pipe sections in the drill string.

BRIEF DESCRIPTION OF THE DRAWINGS

A better understanding of the present invention can be obtained with the following detailed descriptions of the various disclosed embodiments in the drawings:

FIG. 3A is a section view taken along line 3A-3A of FIGS. 2-3, to better illustrate the lateral conduit and its flange.

DETAILED DESCRIPTION OF THE INVENTION

Figure 1A:
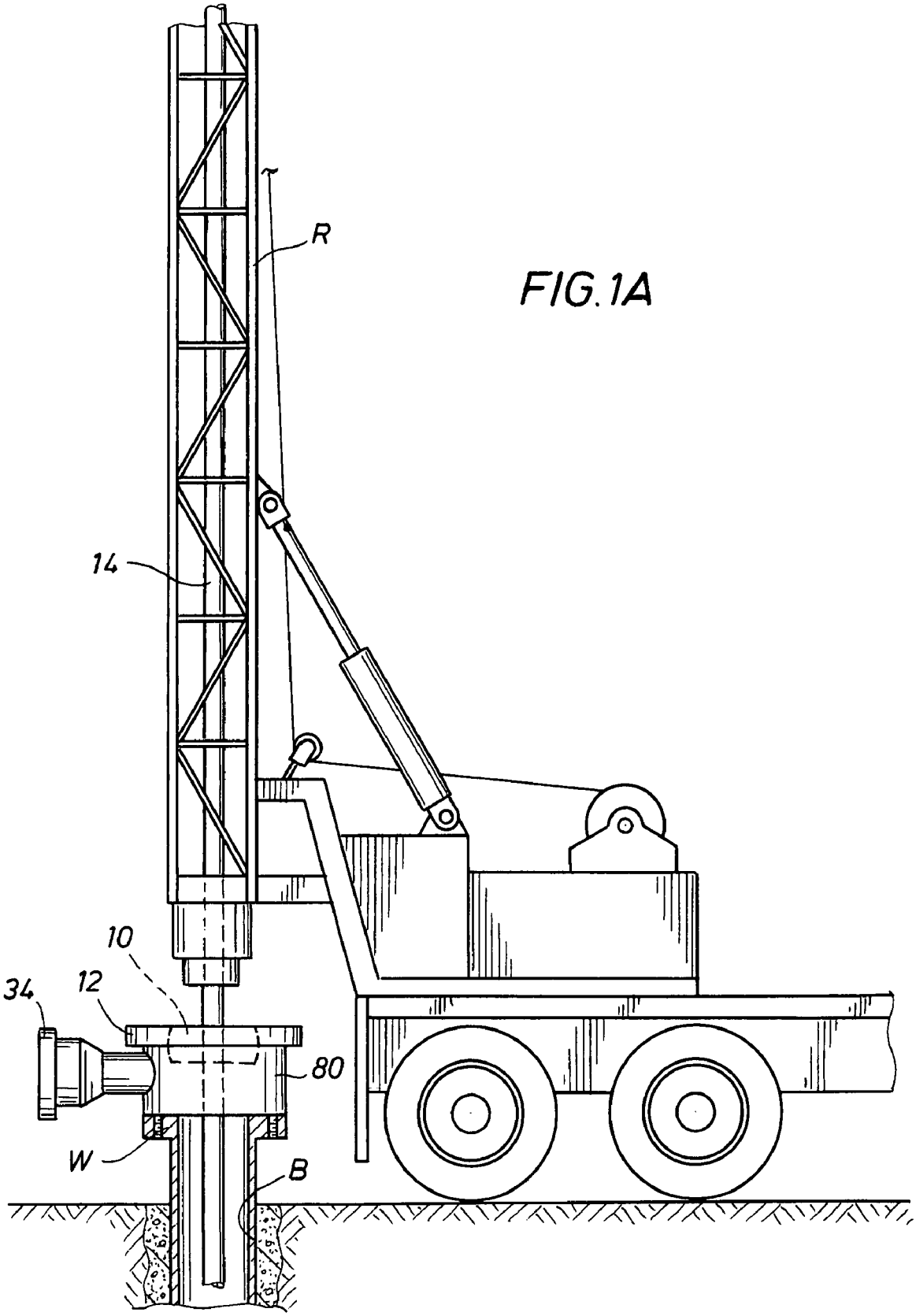
FIG. 1A is a side elevational view of a low profile rotating control device (LP-RCD), illustrated in phantom view, disposed in a LP-RCD housing positioned on a well head, along with an exemplary truck mounted drilling rig.
Figure 1B:
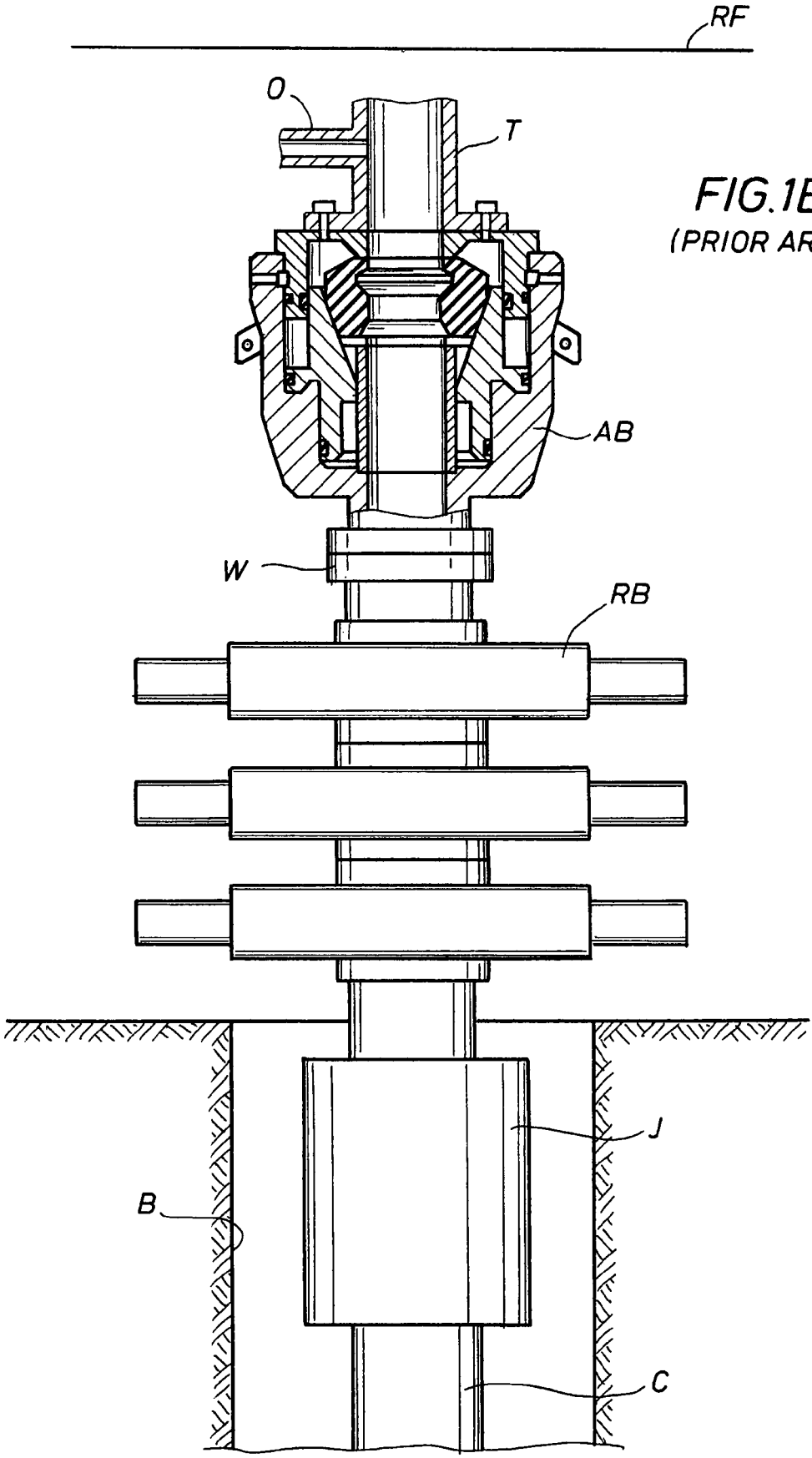
FIG.1B (PRIOR ART)
FIG. 1B is a prior art elevational view in partial cut away section of a nipple with a lateral conduit positioned on an annular BOP that is, in turn, mounted on a ram-type BOP stack.
Figure 1C:
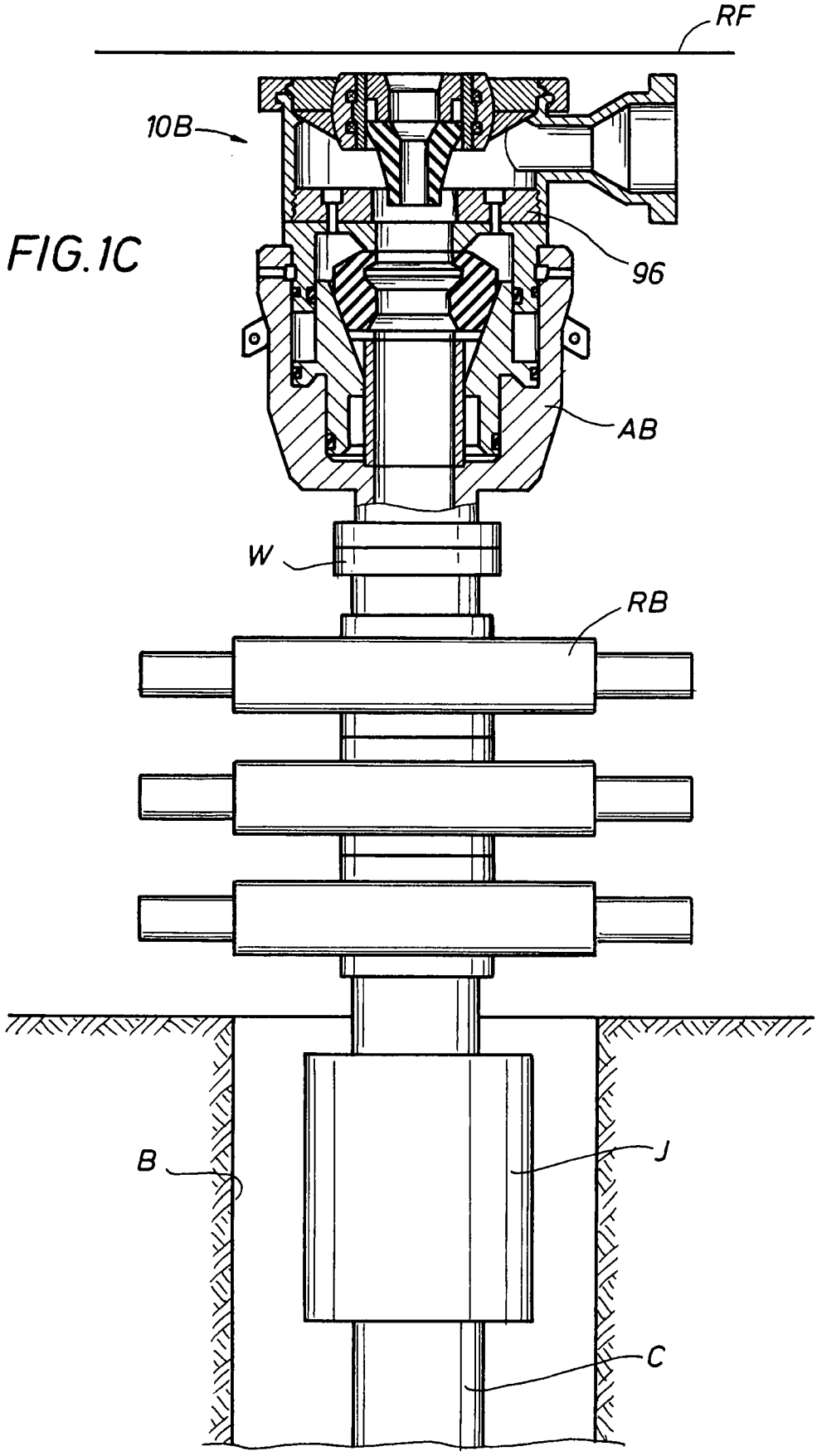
FIG. 1C is similar to FIG. 1B, except that THE nipple has been replaced with a LP-RCD disposed in a LP-RCD housing, which housing is positioned with an attachment retainer ring mounted on the annular BOP, all of which are shown in elevational view in cut away section.

Generally, the present invention involves a system and method for converting a smaller drilling rig with a limited substructure height between a conventional open and non-pressurized mud-return system for hydrostatic pressure drilling, and a closed and pressurized mud-return system for managed pressure drilling or underbalanced drilling, using a low profile rotating control device (LP-RCD), generally designated as 10 in FIG. 1. The LP-RCD is positioned with a desired RCD housing (18, 40, 50, 80, 132, 172). The LP-RCD is further designated as 10A, 10B, or 10C in FIGS. 2-8 depending upon the type of rotation allowed for the inserted tubular (14, 110) about its longitudinal axis, and the location of its bearings. The LP-RCD is designated as 10A if it only allows rotation of the inserted tubular 14 about its longitudinal axis in a horizontal plane, and has its bearings 24 located inside of the LP-RCD housing (18, 40, 50, 172) (FIGS. 2-4, and 7-8), 10B if it allows rotation of the inserted tubular 110 about its longitudinal axis in multiple planes (FIGS. 1C and 5), and 10C if it only allows rotation of the inserted tubular about its longitudinal axis in a horizontal plane, and has its bearings (126, 128) located outside of the LP-RCD housing 132 (FIG. 6). It is contemplated that the three different types of LP-RCDs (as shown with 10A, 10B, and 10C) can be used interchangeably to suit the particular application. It is contemplated that the height (H1, H2, H3, H4, H5) of the combined LP-RCD 10 positioned with the LP-RCD housing (18, 40, 50, 80, 132) shown in FIGS. 2-6 may be relatively short, preferably ranging from approximately 15.0 inches (38.1 cm) to approximately 19.3 inches (49 cm), depending on the type of LP-RCD 10 and LP-RCD housing (18, 40, 50, 80, 132) as described below, although other heights are contemplated as well.

Turning to FIG. 1A, an exemplary embodiment of a truck mounted drilling rig R is shown converted from conventional hydrostatic pressure drilling to managed pressure drilling and/or underbalanced drilling. LP-RCD 10, in phantom, is shown clamped with radial clamp 12 with an LP-RCD housing 80, which housing 80 is positioned directly on a well head W. The well head W is positioned over borehole B as is known in the art. Although a truck mounted drilling rig R is shown in FIG. 1, other drilling rig configurations and embodiments are contemplated for use with LP-RCD 10 for offshore and land drilling, including semi-submersibles, submersibles, drill ships, barge rigs, platform rigs, and land rigs. Although LP-RCD 10 is shown mounted on well head W, it is contemplated that LP-RCD 10 may be mounted on an annular BOP (See e.g. FIG. 1C), casing, or other housing that are known in the art. For example, LP-RCD 10 could be mounted on a Compact GK® annular BOP offered by the Hydril Company or annular BOPs offered by Cameron, both of Houston, Tex. Although the preferred use of any of the disclosed LP-RCDs 10 is for drilling for oil and gas, any of the disclosed LP-RCDs 10 may be used for drilling for other fluids and/or substances, such as water.

FIG. 1B shows a prior art assembly of a tubular T with lateral conduit O mounted on an annular BOP AB below a rig floor RF. Annular BOP AB is directly positioned on well head W. A ram-type BOP stack RB is shown below the well head W, and, if desired, over another annular BOP J positioned with casing C in a borehole B.

Figure 5:
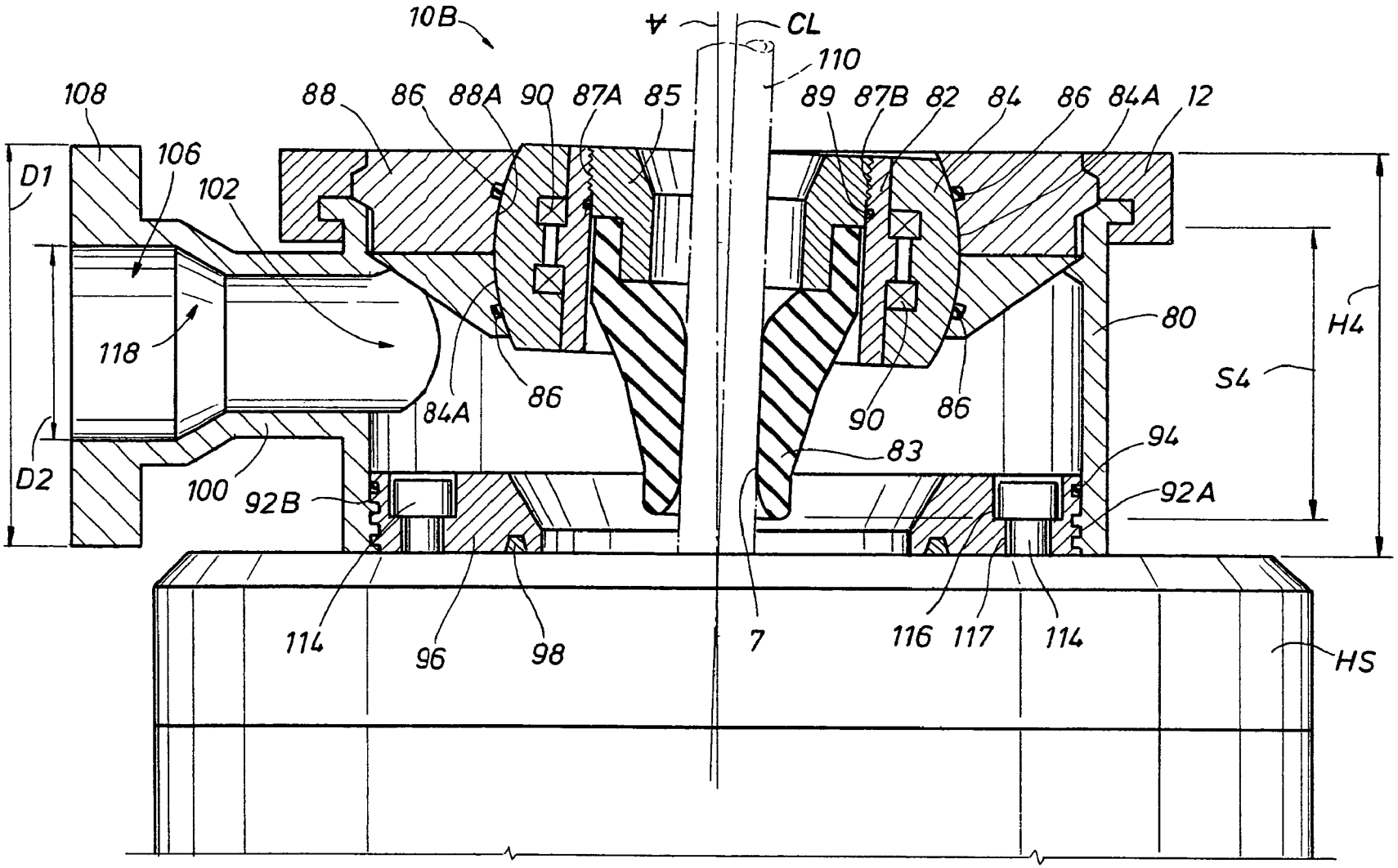
FIG. 5 is an elevational section view of a LP-RCD and LP-RCD housing, which LP-RCD allows rotation of the inserted tubular about its longitudinal axis in multiple planes, and which LP-RCD housing is threadably connected to an attachment retainer ring that is bolted to a lower housing.
Figures 6, 6A:
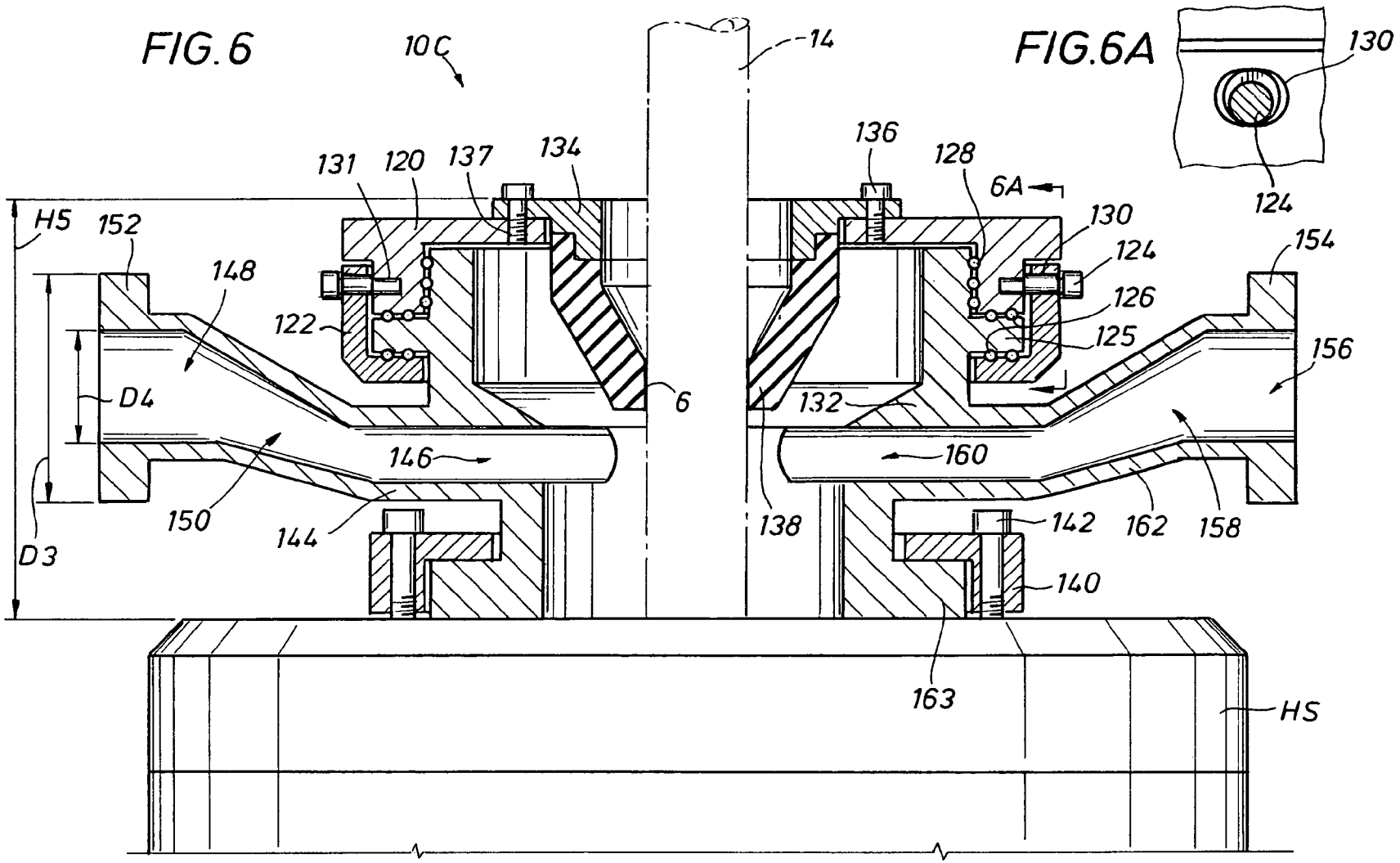
FIG. 6 is an elevational section view of a LP-RCD and LP-RCD housing, which LP-RCD allows rotation of the inserted tubular about its longitudinal axis in a horizontal plane, and which LP-RCD bearings are positioned external to the stationary LP-RCD housing so that the outer member is rotatable.
FIG. 6A is a section view taken along line 6A-6A of FIG. 6, showing the cross section of an eccentric bolt.

Turning to FIG. 1C, LP-RCD 10B, which will be discussed below in detail in conjunction with the embodiment of FIG. 5, is mounted below rig floor RF on an annular BOP AB using an attachment member or retainer ring 96, which will also be discussed below in detail in conjunction with FIG. 5. As discussed herein, any of the LP-RCDs 10 can be mounted on the top of an annular BOP AB using alternative attachment means, such as for example by bolting or nuts used with a threaded rod. Although LP-LCD 10B is shown in FIG. 1C, any LP-RCD 10, as will be discussed below in detail, may be similarly positioned with the annular BOP AB of FIG. 1C or a gas handler BOP as proposed in U.S. Pat. No. 4,626,135.

Figure 2:
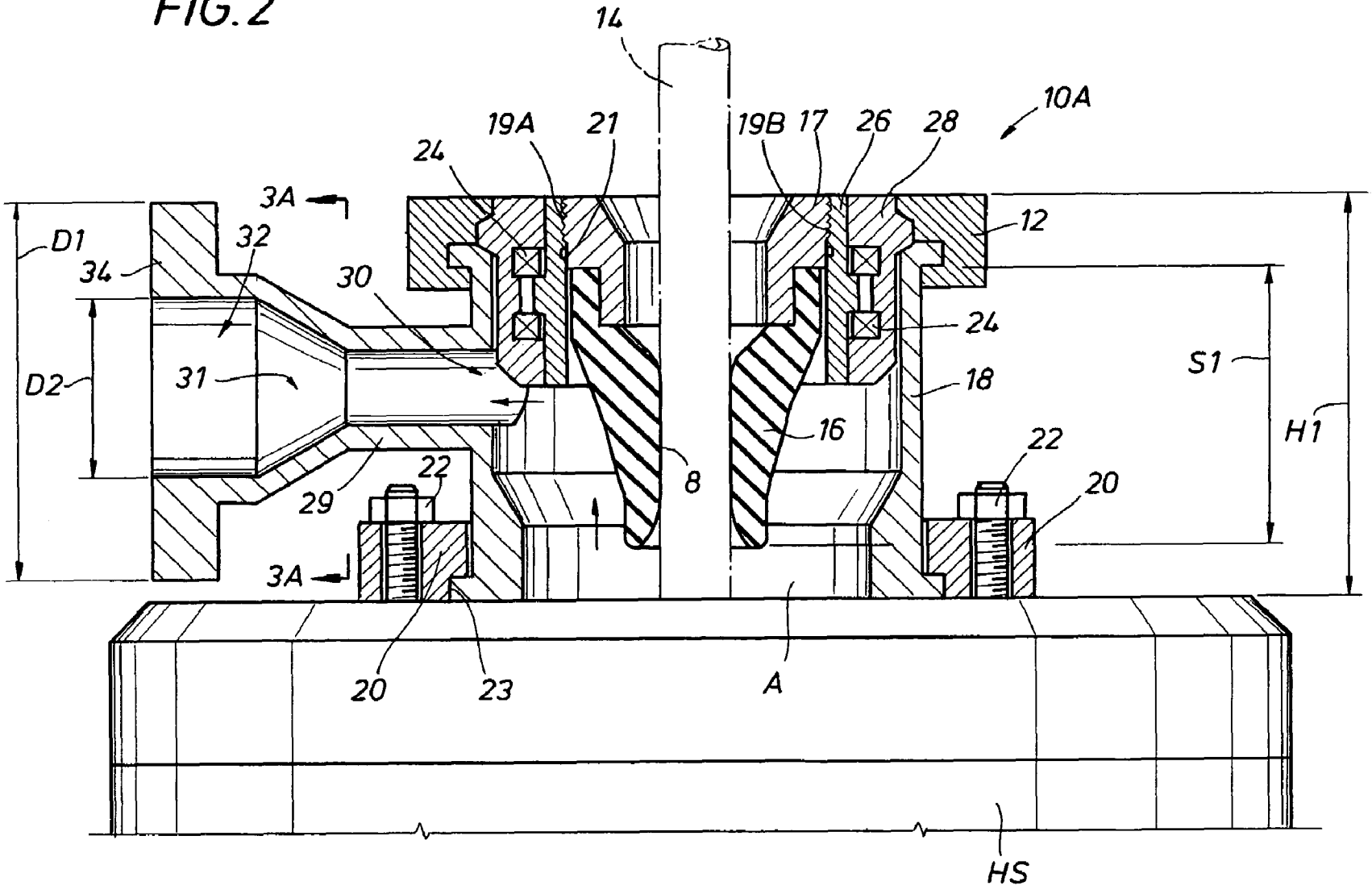
FIG. 2 is an elevational section view of a LP-RCD and LP-RCD housing, which LP-RCD allows rotation of the inserted tubular about its longitudinal axis in a horizontal plane, and which LP-RCD housing is attached to a lower housing with swivel hinges.

FIG. 2 shows tubular 14, in phantom view, inserted through LP-RCD 10A so that tubular 14 can extend through the lower member or housing HS below. Tubular 14 can move slidingly through the LP-RCD 10A, and is rotatable about its longitudinal axis in a horizontal plane. The lower housing HS in FIGS. 2-6 is preferably a compact BOP, although other lower housings are contemplated as described above. LP-RCD 10A includes a bearing assembly and a sealing element, which includes a radial stripper rubber seal 16 supported by a metal seal support member or ring 17 having a thread 19A on the ring 17 radially exterior surface. The bearing assembly includes an inner member 26, an outer member 28, and a plurality of bearings 24 therebetween. Inner member 26 has a passage with thread 19B on the top of its interior surface for a threaded connection with corresponding thread 19A of metal seal ring 17.

LP-RCD 10A is positioned with an LP-RCD housing 18 with radial clamp 12. Clamp 12 may be manual, mechanical, hydraulic, pneumatic, or some other form of remotely operated means. Bottom or lower flange 23 of LP-RCD housing 18 is positioned and fixed on top of the lower housing HS with a plurality of equally spaced attachment members or swivel hinges 20 that are attached to the lower housing HS with threaded rod/nut 22 assemblies. Swivel hinges 20 can be rotated about a vertical axis prior to tightening of the threaded rod/nut 22 assemblies. Before the threaded rod/nut 22 assemblies are tightened, swivel hinges 20 allow for rotation of the LP-RCD housing 18 so that conduit 29, further described below, can be aligned with the drilling rig's existing line or conduit to, for example, its mud pits, shale shakers or choke manifold as discussed herein. Other types of connection means are contemplated as well, some of which are shown in FIGS. 3-6 and/or described below.

Stripper rubber seal 16 seals radially around tubular 14, which extends through passage 8. Metal seal support member or ring 17 is sealed with radial seal 21 in inner member 26 of LP-RCD 10A. Inner member 26 and seal 16 are rotatable in a horizontal plane with tubular 14. A plurality of bearings 24 positioned between inner member 26 and outer member 28 enable inner member 26 and seal 16 to rotate relative to stationary outer member 28. As can now be understood, bearings 24 for the LP-RCD 10A are positioned radially inside LP-RCD housing 18. As can also now be understood, the threaded connection between metal seal support ring 17 and inner member 26 allows seal 16 to be inspected for wear and/or replaced from above. It is contemplated that stripper rubber seal 16 may be inspected and/or replaced from above, such as through the rotary table or floor RF of the drilling rig, in all embodiments of the LP-RCD 10, eliminating the need for physically dangerous and time consuming work under drill rig floor RF.

Figure 3:
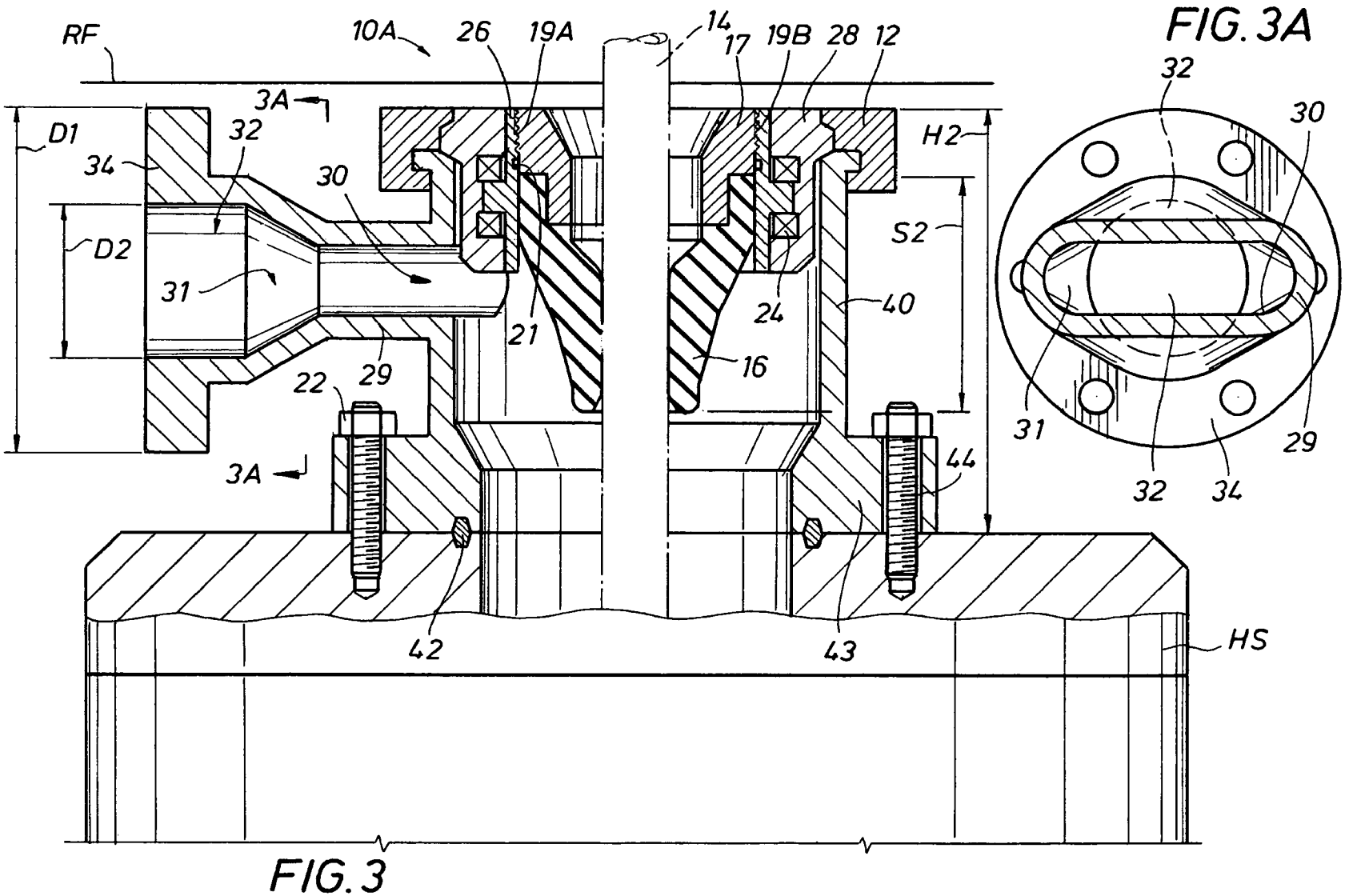
FIG. 3 is similar to FIG. 2, except that the LP-RCD housing is directly attached to a lower housing.

Reviewing both FIGS. 2 and 3, LP-RCD housing conduit 29 initially extends laterally from the housing port, generally shown as 30, with the conduit width greater than its height, and transitions, generally shown as 31, to a flange port, generally shown as 32, that is substantially circular, as is best shown in FIG. 3A. The shape of conduit 29 allows access to threaded rod/nut assemblies 22. It is also contemplated that conduit 29 may be manufactured as a separate part from LP-RCD housing 18, and may be welded to or otherwise sealed with LP-RCD housing 18. The cross sectional or flow areas of the two ports (30, 32), as well as the cross sectional or flow areas of the transition 31, are substantially identical, and as such are maximized, as is shown in FIGS. 2, 3 and 3A. However, different cross sectional shapes and areas are contemplated as well. It is further contemplated that conduit 29 and port 30 may be in alignment with a portion of seal 16. A line or conduit (not shown), including a flexible conduit, may be connected to the flange 34. It is also contemplated that a flexible conduit could be attached directly to the port 30 as compared to a rigid conduit 29. It is contemplated that return drilling fluid would flow from the annulus A through ports (30, 32), which are in communication, as shown with arrows in FIG. 2.

Turning now to FIG. 2, it is contemplated that height H1 of the combined LP-RCD 10A positioned with LP-RCD housing 18 would be approximately 16 inches (40.6 cm), although other heights are contemplated. It is further contemplated that outer diameter D1 of flange 34 would be approximately 15 inches (38.1 cm), although other diameters, shapes and sizes are contemplated as well. As can now be understood, it is contemplated that the outer flange diameter D1 may be substantially the same as housing height H1. For the embodiment shown in FIG. 2, it is contemplated that the ratio of diameter D1 to height H1 may be 0.94, although other optimized ratios are contemplated as well. In the preferred embodiment, it is contemplated that outer diameter D1 of flange 34 may be substantially parallel with height H1. It is also contemplated that diameter D2 of port 32 may be greater than fifty percent of the height H1. It is also contemplated that the seal height S1 may be greater than fifty percent of height H1.

Turning now to FIG. 3, the LP-RCD housing 40 is sealed with radial seal 42 and attached with threaded rod/nut assemblies 22 to lower member or housing HS using attachment member 43. Attachment member 43 may have a plurality of radially equally spaced openings 44 for threaded rod/nut assemblies 22. It is contemplated that height H2 of the combined LP-RCD 10A positioned with LP-RCD housing 40 would be 18.69 inches (47.5 cm), although other heights are contemplated. It is contemplated that the outer diameter D1 of flange 34 may be 15.0 inches (38.1 cm), although other diameters, shapes and sizes are contemplated as well. For the embodiment shown in FIG. 3, it is contemplated that the ratio of diameter D1 to height H2 may be 0.80, although other ratios are contemplated as well. It is also contemplated that seal height S2 may be greater than fifty percent of height H2.

Figure 4:
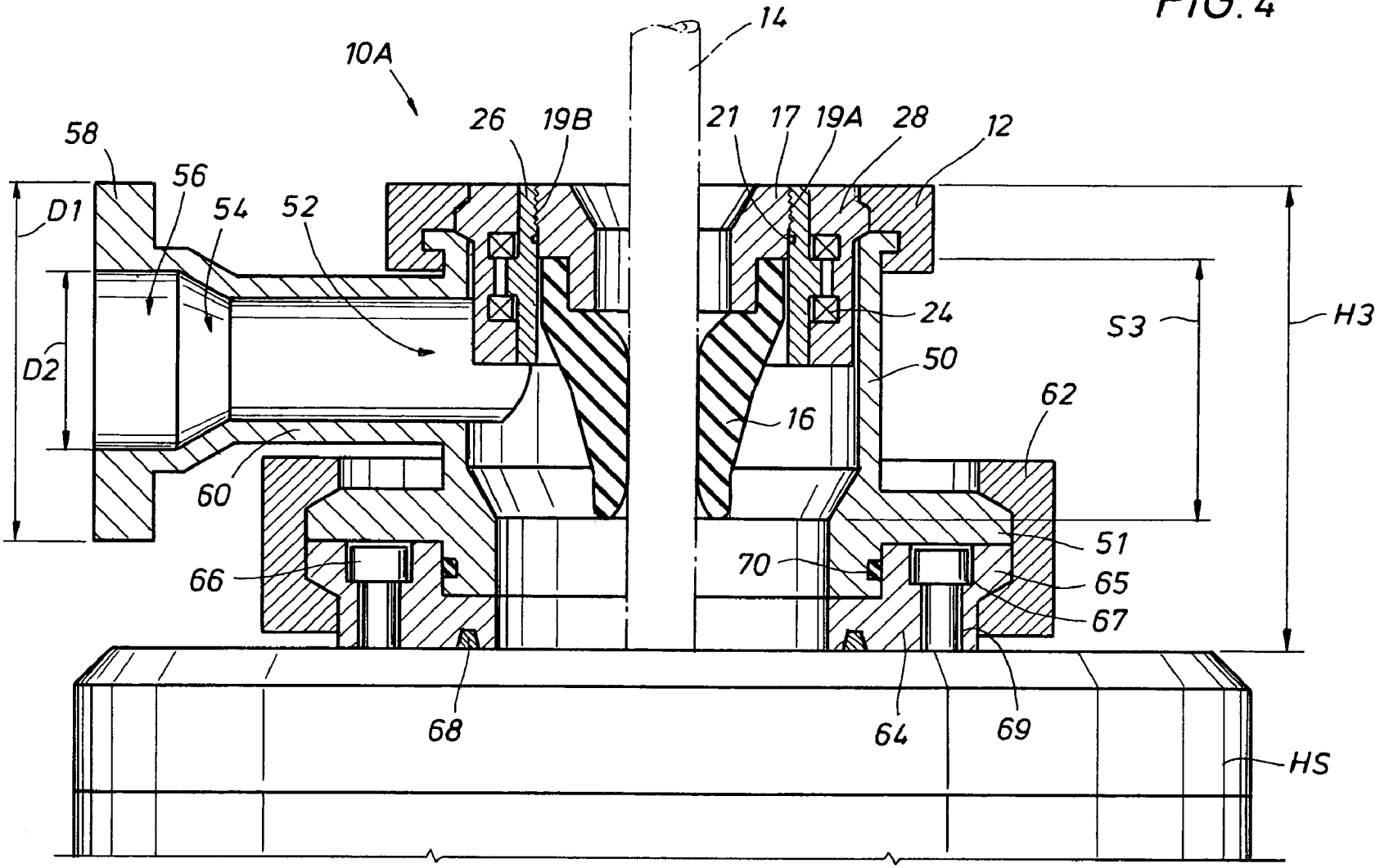
FIG. 4 is similar to FIG. 2, except that the LP-RCD housing is clamped to an attachment retainer ring that is bolted to a lower housing.

Turning next to FIG. 4, LP-RCD housing 50 is sealed with radial seal 70 and clamped with radial clamp 62 to an attachment member or retainer ring 64. Clamp 62 may be manual, mechanical, hydraulic, pneumatic, or some other form of remotely operated means. Clamp 62 is received about base shoulder 51 of LP-RCD housing 50 and radial shoulder 65 of retainer ring 64. Before clamp 62 is secured, LP-RCD housing 50 may be rotated so that conduit 60, described below, is aligned with the drilling rig's existing line or conduit to, for example, its mud pits, shale shakers or choke manifold as discussed herein. Retainer ring 64 is sealed with radial seal 68 and bolted with bolts 66 to lower housing HS. The retainer ring has a plurality of equally spaced openings 69 with recesses 67 for receiving bolts 66.

LP-RCD housing conduit 60 extends from the housing port, shown generally as 52. Conduit 60 has a width greater than its height, and then transitions, generally shown as 54, to a flange port, shown generally as 56, that is substantially circular. The cross sectional or flow areas of the two ports (52, 56), which are in communication, as well as the cross sectional or flow areas of the transition 54 therebetween, are substantially identical. However, different cross sectional areas and shapes are contemplated as well. It is contemplated that conduit 60 and port 52 may be in alignment with a portion of seal 16. A line or conduit (not shown), including a flexible conduit, may be connected to the flange 58. It is also contemplated that a flexible conduit may be attached directly to port 52 as compared to rigid conduit 60. It is contemplated that height H3 of the combined LP-RCD 10A and LP-RCD housing 50 in FIG. 4 would be 19.27 inches (49 cm), although other heights are contemplated. It is further contemplated that outer diameter D1 of flange 58 may be 15.0 inches (38.1 cm), although other diameters and sizes are contemplated as well. For the embodiment shown in FIG. 4, it is contemplated that the ratio of diameter D1 to height H3 may be 0.78, although other ratios are contemplated as well. It is also contemplated that the seal height S3 may be greater than fifty percent of height H3.

FIG. 5 shows a tubular 110, in phantom view, inserted through LP-RCD 10B to lower member or housing HS. Tubular 110 is rotatable in its inserted position about its longitudinal axis CL in multiple planes. This is desirable when the longitudinal axis CL of tubular 110 is not completely vertical, which can occur, for example, if there is misalignment with the wellbore or if there are bent pipe sections in the drill string. The longitudinal axis CL of the tubular 110 is shown in FIG. 5 deviated from the vertical axis V of the wellbore, resulting in the tubular 110 rotating about its longitudinal axis CL in a plane that is not horizontal. While it is contemplated that longitudinal axis CL would be able to deviate from vertical axis V, it is also contemplated that longitudinal axis CL of tubular 110 may be coaxial with vertical axis V, and tubular 110 may rotate about its longitudinal axis CL in a horizontal plane.

LP-RCD 10B includes a bearing assembly and a sealing element, which includes a stripper rubber seal 83 supported by a metal seal support member or ring 85 having a thread 87A on ring 85 radially exterior surface. The bearing assembly includes an inner member 82, an outer ball member 84, and a plurality of bearings 90 therebetween. The inner member 82 has thread 87B on the top of its interior surface for a threaded connection with metal seal support ring 85. Exterior surface 84A of outer ball member 84 is preferably convex. Outer member 84 is sealed with seals 86 to socket member 88 that is concave on its interior surface 88A corresponding with the convex surface 84A of the outer member 84. LP-RCD 10B and socket member 88 thereby form a ball and socket type joint or connection. LP-RCD 10B is held by socket member 88, which is in turn attached to LP-RCD housing 80 with a radial clamp 12. As previously discussed, clamp 12 may be manual, mechanical, hydraulic, pneumatic, or some other form of remotely operated means. It is also contemplated that socket member 88 may be manufactured as a part of LP-RCD housing 80, and not clamped thereto.

LP-RCD housing 80 is sealed with radial seal 94 and threadably connected with radial thread 92A to attachment member or retainer ring 96. Although radial thread 92A is shown on the inside of the LP-RCD housing 80 and thread 92B on the radially outwardly facing surface of retainer ring 96, it is also contemplated that a radial thread could alternatively be located on the radially outwardly facing surface of a LP-RCD housing 80, and a corresponding thread on the inside of a retainer ring. In such an alternative embodiment, the retainer ring would be located outside of the LP-RCD housing. As best shown in FIG. 5, the threaded connection allows for some rotation of LP-RCD housing 80 so that the conduit 100, described below, can be aligned with the drilling rig's existing line or conduit, for example, to its mud pits, shale shakers or choke manifold as discussed herein. Retainer ring 96 is sealed with radial seal 98 and bolted with bolts 114 to the lower member or housing HS. Retainer ring 96 has a plurality of equally spaced openings 117 spaced radially inward of thread 92B with recesses 116 sized for the head of bolts 114.

Stripper rubber seal 83 seals radially around tubular 110, which extends through passage 7. Metal seal support member or ring 85 is sealed by radial seal 89 with inner member 82 of LP-RCD 10B. Inner member 82 and seal 83 are rotatable with tubular 110 in a plane that is 90° from the longitudinal axis or center line CL of tubular 110. A plurality of bearings 90 positioned between inner member 82 and outer member 84 allow inner member 82 to rotate relative to outer member 84. As best shown in FIG. 5, the ball and socket type joint additionally allows outer member 84, bearings 90, and inner member 82 to rotate together relative to socket member 88. As can now be understood, LP-RCD 10B allows the inserted tubular 110 to rotate about its longitudinal axis in multiple planes, including the horizontal plane. Also, as can now be understood, LP-RCD 10B accommodates misaligned and/or bent tubulars 110, and reduces side loading. It is contemplated that stripper rubber seal 83 may be inspected and, if needed, replaced through the rotary table of the drilling rig in all embodiments of the disclosed LP-RCDs, eliminating the need for physically dangerous and time consuming work under the drill rig floor.

LP-RCD housing 80 includes conduit 100 that initially extends from the housing port, generally shown as 102, with conduit 100 having a width greater than its height, and transitions, generally shown as 118, to a flange port, generally shown as 106, that is substantially circular. The cross sectional or flow areas of the two ports (102, 106), which are in communication, as well as the different cross sectional areas of the transition 118 therebetween, are substantially identical, similar to that shown in FIG. 3A. However, different cross sectional areas and shapes are contemplated as well. It is contemplated that conduit 100 and port 102 may be in alignment with a portion of seal 83. A line or conduit (not shown), including a flexible conduit, may be connected to the flange 108. It is also contemplated that outlet conduit 100 may be manufactured as a separate part from LP-RCD housing 80, and may be welded to LP-RCD housing 80. It is also contemplated that a flexible conduit may be attached directly to port 102 as compared to a rigid conduit 100.

It is contemplated that height H4 of the combined LP-RCD 10B and the LP-RCD housing 80 in FIG. 5 may be 14.50 inches (38.1 cm), although other heights are contemplated. It is further contemplated that the outer diameter D1 of flange 108 may be approximately 15.0 inches (38.1 cm), although other diameters and sizes are contemplated as well. For the embodiment shown in FIG. 5, it is contemplated that the ratio of diameter D1 to height H4 may be 1.03, although other ratios are contemplated as well. It is also contemplated that seal height S4 may be greater than fifty percent of height H4.

Turning to FIG. 6, a tubular 14, in phantom view, is shown inserted through LP-RCD 10C to the lower housing HS. Tubular 14 can move slidingly through LP-RCD 10C, and is rotatable about its longitudinal axis in a horizontal plane. LP-RCD 10C includes a bearing assembly and a sealing element, which includes a radial stripper rubber seal 138 supported by metal seal support member or ring 134 attached thereto. The bearing assembly includes top ring 120, side ring 122, eccentric bolts 124, a plurality of radial bearings 128, and a plurality of thrust bearings 126. Metal seal support ring 134 has a plurality of openings, and top ring 120 has a plurality of equally spaced threaded bores 137, that may be aligned for connection using bolts 136. Bolts 136 enable inspection and replacement of stripper rubber seal 138 from above. Other connection means, as are known in the art, are contemplated as well.

LP-RCD 10C is positioned with an LP-RCD housing 132 with the bearing assembly. As best shown in FIG. 6A, eccentric bolts 124 may be positioned through oval shaped bolt channels 130 through side ring 122. Bolts 124 are threadably connected into threaded bores 131 in top ring 120. When bolts 124 are tightened, side ring 122 moves upward and inward, creating pressure on thrust bearings 126, which creates pressure against radial flange 125 of LP-RCD housing 132, positioning LP-RCD 10C with LP-RCD housing 132. The variable pressure on thrust bearings 126, which may be induced before a tubular 14 is inserted into or rotating about its longitudinal axis in the LP-RCD 10C, allows improved thrust bearing 126 performance. Bolts 124 may be tightened manually, mechanically, hydraulically, pneumatically, or some other form of remotely operated means. As an alternative embodiment, it is contemplated that washers, shims, or spacers, as are known in the art, may be positioned on non-eccentric bolts inserted into top ring 120 and side ring 122. It is also contemplated that spacers may be positioned above thrust bearings 126. Other connection means as are known in the art are contemplated as well.

The bottom or lower flange 163 of LP-RCD housing 132 is positioned on top of lower member or housing HS with a plurality of attachment members or swivel hinges 140 that may be bolted to lower housing HS with bolts 142. Swivel hinges 140, similar to swivel hinges 20 shown in FIG. 2, may be rotated about a vertical axis prior to tightening of the bolts 142. Other types of connections as are known in the art are contemplated as well, some of which are shown in FIGS. 2-5 and/or described above. The stripper rubber seal 138 seals radially around the tubular 14, which extends through passage 6. As discussed above, seal 138 may be attached to the metal seal support member or ring 134, which support ring 134 may be, in turn, bolted to top ring 120 with bolts 136. As can now be understood, it is contemplated that stripper rubber seal 138 may be inspected and, if needed, replaced through the rotary table of the drilling rig in all embodiments of the LP-RCD 10, eliminating the need for physically dangerous and time consuming work under the drill rig floor.

Top ring 120, side ring 122, and stripper rubber seal 138 are rotatable in a horizontal plane with the tubular 14. A plurality of radial 128 and thrust 126 bearings positioned between the LP-RCD housing 132 on the one hand, and the top ring 120 and side ring 122 on the other hand, allow seal 138, top ring 120, and side ring 122 to rotate relative to the LP-RCD stationary housing 132. The inner race for the radial bearings, shown generally as 128, may be machined in the outside surfaces of the LP-RCD housing 132. As can now be understood, the bearings (126, 128) of LP-RCD 10C are positioned outside of LP-RCD housing 132.

LP-RCD housing 132 includes dual and opposed conduits (144, 162) that initially extend from dual and opposed housing ports, generally shown as (146, 160), with a width (preferably 14 inches or 35.6 cm) greater than their height (preferably 2 inches or 5.1 cm), and transition, generally shown as (150, 158), to flange ports, generally shown as (148, 156), that are substantially circular. The shape of conduits (144, 162) allow access to bolts 142. Housing ports (146, 160) are in communication with their respective flange ports (148, 156). The two ports, each of equal area, provide twice as much flow area than a single port. Other dimensions are also contemplated. It is also contemplated that conduits (144, 162) may be manufactured as a separate part from the LP-RCD housing 132, and be welded to the LP-RCD housing 132. The cross sectional or flow areas of the ports (146, 148, 156, 160), as well as the cross sectional or flow areas of the transition between them (150, 158) are preferably substantially identical. However, different cross sectional areas and shapes are contemplated as well. Lines or conduits (not shown), including flexible conduits, may be connected to flanges (152, 154).

It is contemplated that height H5 of the combined LP-RCD 10C positioned with LP-RCD housing 132 in FIG. 6 may be 15.0 inches (38.1 cm), although other heights are contemplated. It is further contemplated that the outer diameter D3 of flanges (152, 154) may be 6.0 inches (15.2 cm), although other diameters and sizes are contemplated as well. For the embodiment shown in FIG. 6, it is contemplated that the ratio of diameter D3 to height H5 may be 0.4, although other ratios are contemplated as well. In the preferred embodiment, it is contemplated that diameter D3 of flanges (152, 154) may be substantially parallel with height H5.

Although two conduits (144, 162) are shown in FIG. 6, it is also contemplated that only one larger area conduit may be used instead, such as shown in FIGS. 1A, 1C, 2-5 and 7. Also, although two conduits (144, 162) are shown only in FIG. 6, it is also contemplated that two conduits could be used with any LP-RCD and LP-RCD housing (18, 40, 50, 80, 132, 172) of the present invention shown in FIGS. 1A, 1C, 2-7 to provide more flow area or less flow area per conduit. It is contemplated that two conduits may be useful to reduce a restriction of the flow of mud returns if the stripper rubber seal (16, 83, 138) is stretched over the outside diameter of an oversized tool joint or if a foreign obstruction, partly restricts the returns into the conduits. The two conduits would also reduce pressure spikes within the wellbore whenever a tool joint is tripped into or out of the LP-RCD with the rig pumps operating. Alternatively, when tripping a tool joint out through the LP-RCD, one of the two conduits may be used as an inlet channel for the pumping of mud from the surface to replace the volume of drill string and bottom hole assembly that is being removed from the wellbore. Otherwise, a vacuum may be created on the wellbore when tripping out, in a piston effect known as swabbing, thereby inviting kicks. It is also contemplated that two conduits may facilitate using lifting slings or fork trucks to more easily maneuver the LP-RCD on location. It is further contemplated, though not shown, that seal 138 may have a height greater than fifty percent of height H5.

Figure 7:
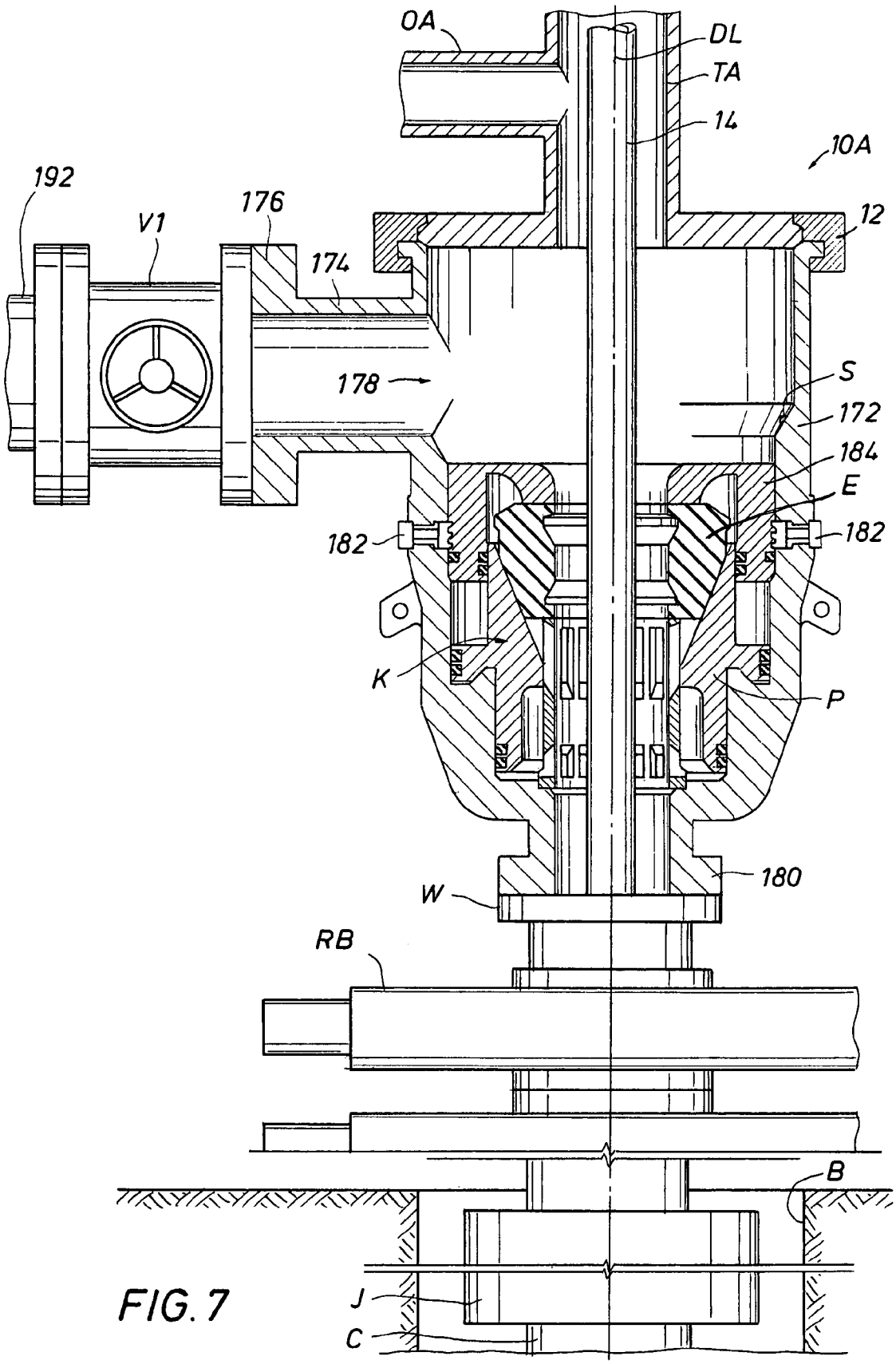
FIG. 7 is an elevational section view of a nipple with a lateral conduit positioned on an integral combination housing for use with an annular BOP seal and a RCD, and a valve attached with the housing, which housing is mounted on a ram-type BOP stack.

Turning to FIG. 7, a nipple or tubular TA with lateral conduit OA is attached with integral housing 172 using radial clamp 12. Integral housing 172 is mounted above a ram-type BOP stack RB shown below the well head W, and, if desired, over another annular BOP J positioned with casing C in a borehole B. Integral housing 172 contains known components K, such as piston P, containment member 184, and a plurality of connectors 182, for an annular BOP, such as proposed in U.S. Pat. No. 4,626,135. Annular seal E along axis DL may be closed upon the inserted tubular 14 with components K, such as proposed in the '135 patent. It is contemplated that components K may preferably be compact, such as those in the Compact GK® annular BOP offered by the Hydril Company of Houston, Tex.

Housing 172 has a lateral conduit 174 with housing port 178 that is substantially circular, and perpendicular to axis DL. Port 178 is above seal E while being in communication with seal E. It is also contemplated that conduit 174 may be manufactured as a separate part from LP-RCD housing 172, and may be welded to LP-RCD housing 172. If desired, valve V1 may be attached to flange 176, and a second lateral conduit 192 may be attached with valve V1. Valve V1 may be manual, mechanical, electrical, hydraulic, pneumatic, or some other remotely operated means. Sensors S will be discussed below in detail in conjunction with FIG. 8.

FIG. 7 shows how integral housing 172 may be configured for conventional drilling. It is contemplated that when valve V1 is closed, drilling returns may flow through open conduit OA to mud pits, shale shakers and/or other non-pressurized mud treatment equipment. It should be noted that the presence of nipple or tubular TA with lateral conduit OA is optional, depending upon the desired configuration. Should nipple or tubular TA with lateral conduit OA not be present, returns during conventional drilling may be taken through port 178 (optional), valve V1 and conduit 192. As will be discussed below in conjunction with FIG. 9, other valves (V2, V3) and conduits (194, 196) are also contemplated, in both configurations valve V1 is opened.

Figure 8:
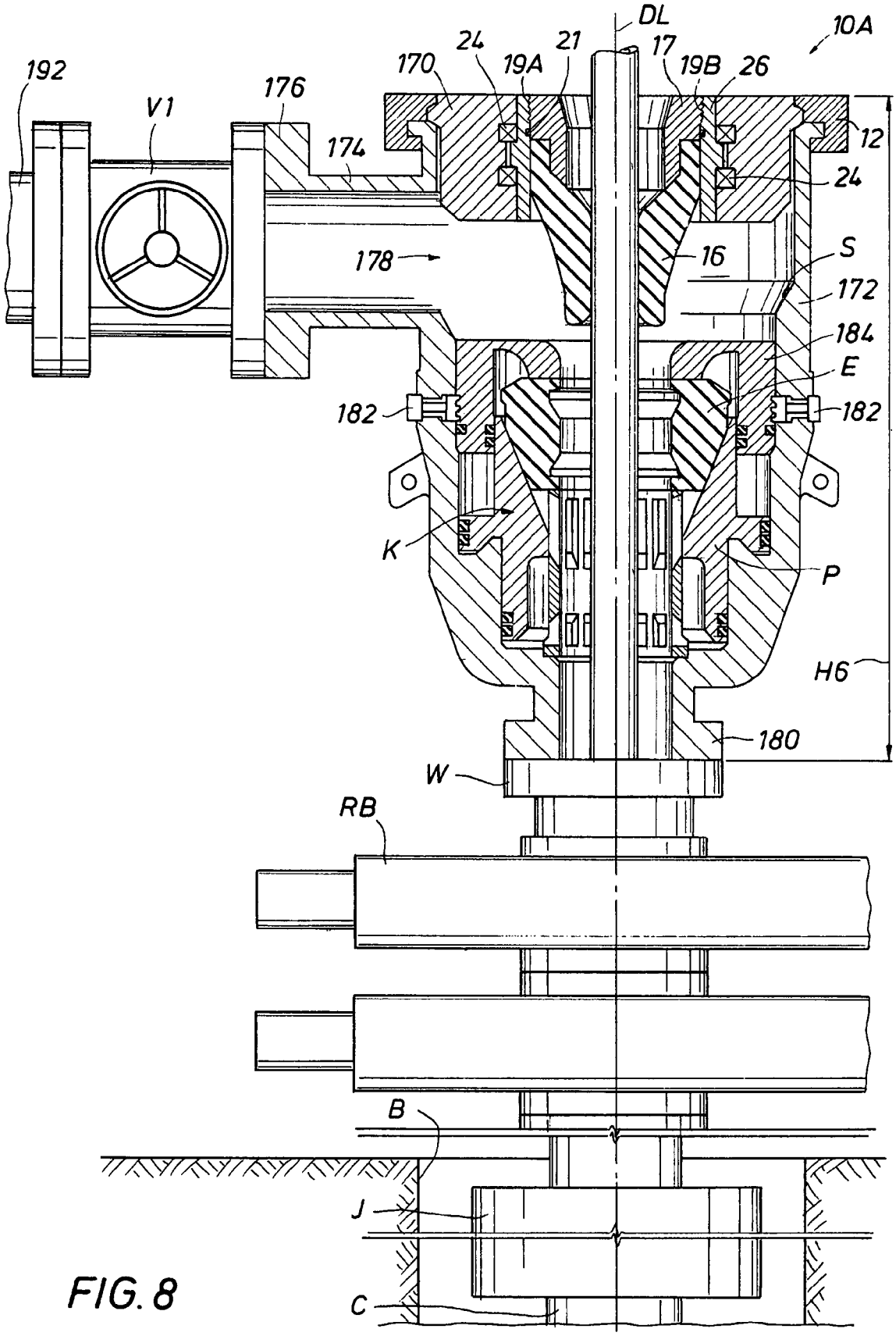
FIG. 8 is an elevational section view of the integral housing as shown in FIG. 7 but with the nipple removed and a LP-RCD installed.

Turning to FIG. 8, LP-RCD 10A is now attached with integral housing 172 using radial clamp 12. LP-RCD 10A includes a bearing assembly and a sealing element, which includes radial stripper rubber seal 16 supported with metal seal support member or ring 17 having thread 19A on ring 17 exterior radial surface. While FIG. 8 is shown with LP-RCD 10A, other LP-RCDs as disclosed herein, such as LP-RCD 10B, 10C, could be used. The bearing assembly includes inner member 26, outer member 170, and a plurality of bearings 24 therebetween, which bearings 24 enable inner member 26 to rotate relative to the stationary outer member 170. Inner member 26 and outer member 170 are coaxial with longitudinal axis DL. Inner member 26 and seal 16 are rotatable with inserted tubular 14 in a horizontal plane about axis DL. Inner member 26 has thread 19B on the top of its interior surface for a threaded connection with corresponding thread 19A of the metal seal support member or ring 17. Valve V1 is attached to flange 176, and a second lateral conduit 192 is attached with valve V1. It is contemplated that conduit 174 and port 178 may be in alignment with a portion of seal 16. Annular seal E is coaxial with and below seal 16 along axis DL.

FIG. 8 shows how integral housing 172 and LP-RCD 10A may be configured for managed pressure drilling. It is contemplated that valve V1 is open, and drilling returns may flow through housing port 178 and lateral conduit 192 to a pressure control device, such as a choke manifold (not shown). As will be discussed below in conjunction with FIG. 10, other valves (V2, V3) and conduits (194, 196) are also contemplated.

As can now be understood, an annular BOP seal E and its operating components K are integral with housing 172 and the LP-RCD 10A to provide an overall reduction in height H6 while providing functions of both an RCD and an annular BOP. Moreover, the need for an attachment member between a LP-RCD 10 and the BOP seal E, such as attachment members (20, 43, 64, 96, 140) along with a bottom or lower flange (23, 163) in FIGS. 2-6, have been eliminated. Therefore, both the time needed and the complexity required for rigging up and rigging down may be reduced, as there is no need to align and attach (or detach) a LP-RCD housing (18, 40, 50, 80, 132), such as shown in FIGS. 2-6, with a lower housing HS using one of the methods previously described in conjunction with FIGS. 2-6. Furthermore, height H6 in FIG. 8 of the integral RCD and annular BOP may be less than a combination of any one of the heights (H1, H2, H3, H4, H5) shown in FIGS. 2-6 and the height of lower housing HS (which preferably is an annular BOP). This is made possible in part due to the elimination of the thicknesses of the attachment member (20, 43, 64, 96, 140), a bottom or lower flange (23, 163) and the top of lower housing HS.

It is contemplated that the operation of the integral housing 172 with annular BOP and LP-RCD 10A, as shown in FIG. 8, may be controlled remotely from a single integrated panel or console. Sensors S in housing 172 may detect pressure, temperature, flow, and/or other information as is known in the art, and relay such information to the panel or console. Such sensors S may be mechanical, electrical, hydraulic, pneumatic, or some other means as is known in the art. Control of LP-RCD 10A from such remote means includes bearing lubrication flow and cooling.

Threaded connection (19A, 19B) between ring 17 and inner member 26 allows seal 16 to be inspected or replaced from above when the seal 16 is worn. Full bore access may be obtained by removing clamp 12 and LP-RCD 10A including bearing assembly (24, 26, 170). Seal E may then be inspected or replaced from above by disconnecting connectors 182 from containment member 184, removing containment member 184 from housing 172 via the full bore access, thereby exposing seal E from above. It is also contemplated that removal of ring 17 while leaving the bearing assembly (24, 26, 170) in place may allow limited access to seal E for inspection from above.

It should be understood that although housing lower flange 180 is shown over ram-type BOP stack RB in FIGS. 7-8, it may be positioned upon a lower housing, tubular, casing, riser, or other member using any connection means either described above or otherwise known in the art. It should also be understood that although LP-RCD 10A is shown in FIG. 8, it is contemplated that LP-RCD (10B, 10C) may be used as desired with housing 172.

Figure 9:
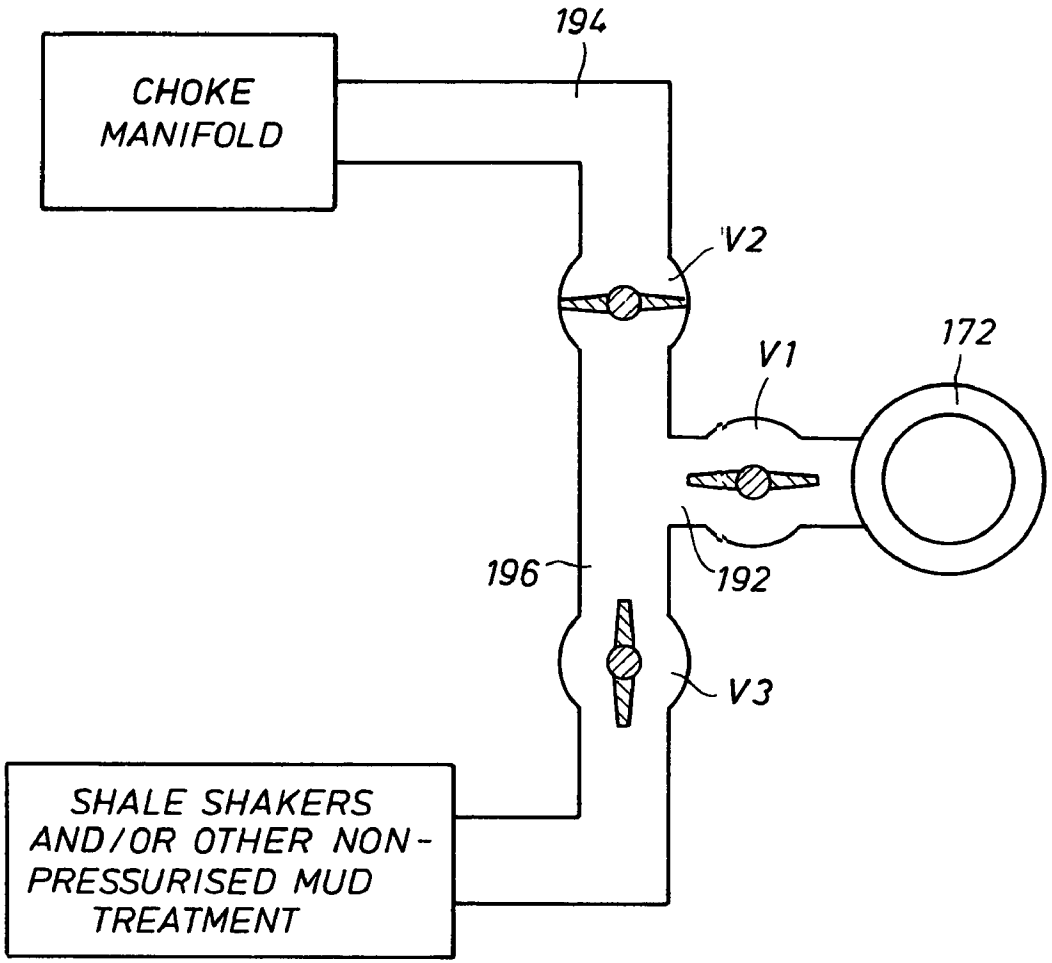
FIG. 9 is a schematic plan view of an integral housing with LP-RCD removed as shown in FIG. 7 with the valves positioned for communication between the housing and a shale shakers and/or other non-pressurized mud treatment.

Turning to FIG. 9, integral housing 172 is shown, as in FIG. 7, with no LP-RCD 10A installed. This reflects a configuration in which nipple or tubular TA with lateral conduit OA is not present during conventional drilling. Valve V1 is attached to housing 172 (e.g. such as shown in FIG. 7), and lateral conduit 192 is attached to valve V1. Other conduits (194, 196) and valves (V2, V3) are shown in communication with conduit 192, for example by a T-connection. Valves (V2, V3) may be manual, mechanical, electrical, hydraulic, pneumatic, or some other form of remotely operated means. One conduit 194 leads to a pressure control device, such as a choke manifold, and the other conduit 196 leads to the shale shakers and/or other non-pressurized mud treatment equipment. FIG. 9 shows a configuration for conventional drilling, as it is contemplated that valves (V1, V3) may be open, valve V2 may be closed, and drilling returns may flow through housing port 178 (shown in FIG. 7) and conduits (192, 196) to mud pits, shale shakers and/or other non-pressurized mud treatment equipment.

Figure 10:
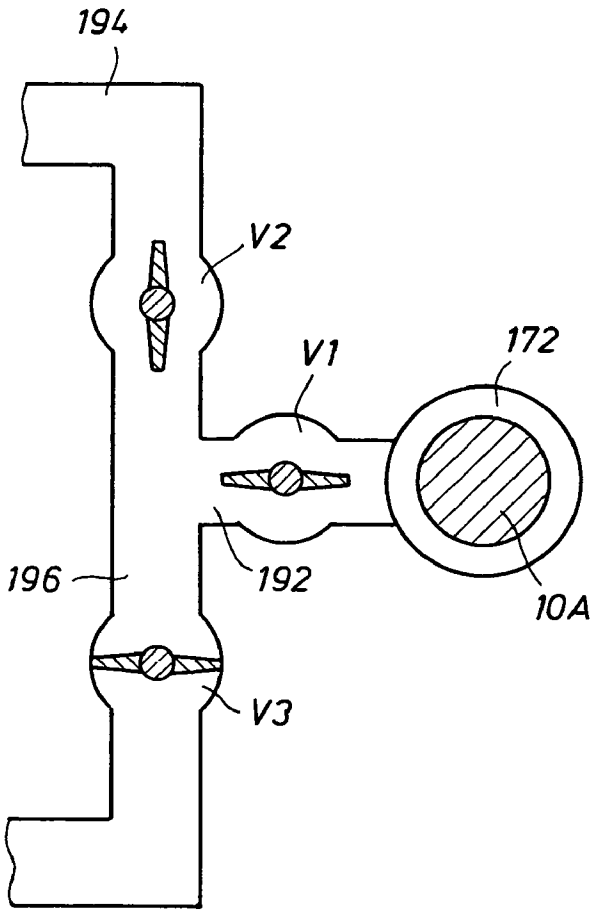
FIG. 10 is a schematic plan view of an integral housing with LP-RCD installed as shown in FIG. 8 with the valves positioned for communication between the housing and a choke manifold.

Turning to FIG. 10, integral housing 172 is shown, as in FIG. 8, with LP-RCD 10A installed and attached. FIG. 10 shows a configuration for managed pressure drilling, as it is contemplated that valves (V1, V2) are open, valve V3 is closed, and drilling returns may flow through housing port 178 and conduits (192, 194) to a pressure control device, such as a choke manifold.

It is contemplated that the desired LP-RCD 10 may have any type or combination of seals to seal with inserted tubulars (14, 110), including active and/or passive stripper rubber seals. It is contemplated that the connection means between the different LP-RCD housings (18, 40, 50, 80, 132, 172) and the lower member or housing HS shown in FIGS. 2-6 and/or described above, such as with threaded rod/nut assemblies 22, bolts (22, 66, 114, 142), swivel hinges (20, 140), retainer rings (64, 96), clamps 62, threads 92, and seals (42, 68, 94, 98), may be used interchangeably. Other attachment methods as are known in the art are contemplated as well.

Method of Use

LP-RCD 10 may be used for converting a smaller drilling rig or structure between conventional hydrostatic pressure drilling and managed pressure drilling or underbalanced drilling. A LP-RCD (10A, 10B, 10C) and corresponding LP-RCD housing (18, 40, 50, 80, 132, 172) may be mounted on top of a lower member or housing HS (which may be a BOP) using one of the attachment members and connection means shown in FIGS. 2-6 and/or described above, such as for example swivel hinges 140 and bolts 142 with LP-RCD 10C. Integral housing 172 may be used to house an annular BOP seal E, and a desired LP-RCD (10A, 10B, 10C) may then be positioned with housing 172 using one of the means shown in FIGS. 2-8 and/or described above, such as for example using radial clamp 12 with LP-RCD 10A.

Conduit(s) may be attached to the flange(s) (34, 58, 108, 152, 154, 176), including the conduit configurations and valves shown in FIGS. 9 and 10. The thrust bearings 126 for LP-RCD 10C, if used, may be preloaded with eccentric bolts 124 as described above. Drill string tubulars (14, 110), as shown in FIGS. 2-8, may then be inserted through a desired LP-RCD 10 for drilling or other operations. LP-RCD stripper rubber seal (16, 83, 138) rotates with tubulars (14, 110), allows them to slide through, and seals the annular space A so that drilling fluid returns (shown with arrows in FIG. 2) will be directed through the conduit(s) (29, 60, 100, 144, 162, 174). When desired the stripper rubber seal (16, 83, 138) may be inspected and, if needed, replaced from above, by removing ring (17, 85, 134). Moreover, for housing 172, shown in FIGS. 7-10, annular BOP seal E may be inspected and/or removed as described above.

For conventional drilling using housing 172 in the configuration shown in FIG. 7 with no LP-RCD 10 installed, valve V1 may be closed, so that drilling returns flow through lateral conduit OA to the mud pits, shale shakers or other non-pressurized mud treatment equipment. For conventional drilling with the conduit/valve configuration in FIG. 9 (and when nipple or tubular TA with lateral conduit OA is not present), valves (V1, V3) are open, valve V2 is closed so that drilling returns may flow through housing port 178 and conduits (192, 196) to mud pits, shale shakers and/or other non-pressurized mud treatment equipment. For managed pressure drilling using housing 172 in the configuration shown in FIG. 8 with LP-RCD 10A installed and attached, valve V1 is opened, so that drilling returns flow through housing port 178 and conduit 192 to a pressure control device, such as a choke manifold. For managed pressure drilling with the configuration in FIG. 10, valves (V1, V2) are open, valve V3 is closed so that drilling returns may flow through housing port 178 and conduits (192, 194) to a pressure control device, such as a choke manifold.

As is known by those knowledgeable in the art, during conventional drilling a well may receive an entry of water, gas, oil, or other formation fluid into the wellbore. This entry occurs because the pressure exerted by the column of drilling fluid or mud is not great enough to overcome the pressure exerted by the fluids in the formation being drilled. Rather than using the conventional practice of increasing the drilling fluid density to contain the entry, integral housing 172 allows for conversion in such circumstances, as well as others, to managed pressure drilling.

To convert from the configurations shown in FIGS. 7 and 9 for conventional drilling to the configurations shown in FIGS. 8 and 10 for managed pressure drilling, conventional drilling operations may be temporarily suspended, and seal E may be closed upon the static inserted tubular 14. It is contemplated that, if desired, the operator may kill the well temporarily by circulating a weighted fluid prior to effecting the conversion from conventional to managed pressure drilling. The operator may then insure that no pressure exists above seal E by checking the information received from sensor S. If required, any pressure above seal E may be bled via a suitable bleed port (not shown). Valve V1 may then be closed. If present, the nipple or tubular TA may then be removed, and the LP-RCD 10 positioned with housing 172 as shown in FIG. 8 using, for example, clamp 12. Valves (V1, V2) are then opened for the configuration shown in FIG. 10, and valve V3 is closed to insure that drilling returns flowing through housing port 178 are directed or diverted to the choke manifold. Seal E may then be opened, drilling operations resumed, and the well controlled using a choke and/or pumping rate for managed pressure drilling. If the operator had previously killed the well by circulating a weighted fluid, this fluid may then be replaced during managed pressure drilling by circulating a lighter weight drilling fluid, such as that in use prior to the kick. The operation of the integral annular BOP and LP-RCD 10A may be controlled remotely from a single integrated panel or console in communication with sensor S. Should it be desired to convert back from a managed pressure drilling mode to a conventional drilling mode, the above conversion operations may be reversed. It should be noted, however, that removal of LP-RCD 10A may not be necessary (but can be performed if desired). For example, conversion back to conventional drilling may be simply achieved by first ensuring that no pressure exists at surface under static conditions, then configuring valves V1, V2 and V3 to divert returns directly to the shale shakers and/or other non-pressurized mud treatment system, as shown in FIG. 9.

The foregoing disclosure and description of the invention are illustrative and explanatory thereof, and various changes in the details of the illustrated apparatus and system, and the construction and the method of operation may be made without departing from the spirit of the invention.

We claim:

1. A system for forming a borehole using a rotatable tubular, the system comprising:

a housing having a height and disposed above the borehole, said housing having a lateral port;

a bearing assembly having an inner member and an outer member and being positioned with said housing, one of said members rotatable with the tubular relative to the other said member and one of said members having a longitudinal passage through which the tubular may extend;

a seal having a height to sealably engage the rotatable tubular with said bearing assembly;

a plurality of bearings disposed between said inner member and said outer member;

a flange having an outer diameter and a port, wherein said housing lateral port communicating with said flange port;

a conduit disposed between said housing port and said flange, wherein said conduit having a width perpendicular to a height, and wherein said conduit width being greater than said conduit height at said housing port;

a lower member above the borehole; and an attachment member for attaching said housing to said lower member, wherein said housing lateral port is in alignment with said seal; and wherein said bearing assembly partially blocks said lateral port.

2. The system of claim 1, wherein the lower member is an annular blowout preventer.

3. The system of claim 1, wherein said flange outer diameter is substantially the same as said height of said housing and said bearing assembly after said bearing assembly is positioned with said housing.

4. The system of claim 1, wherein said flange outer diameter is at least eighty percent of said housing height of said housing and said bearing assembly after said bearing assembly is positioned with said housing.

5. The system of claim 4, wherein said seal being fabricated from a rubber and said seal height is greater than fifty percent of said height of said housing and said bearing assembly after said bearing assembly is positioned with said housing.

6. The system of claim 5, wherein said flange outer diameter is at least eighty percent of said housing height of said housing and said bearing assembly after said bearing assembly is positioned with said housing.

7. The system of claim 1, wherein said conduit width and said conduit height being equal at said flange.

8. The system of claim 1, further comprising:

said seal being fabricated from a rubber; and a non-rubber support member for supporting said rubber seal with one of said members, wherein said non-rubber supporting member allows removal of said rubber seal from both of said inner member and said outer member.

9. The system of claim 1, wherein said flange port having a flange port diameter that is at least fifty percent of said housing height of said housing and said bearing assembly after said bearing assembly is positioned with said housing.

10. The system of claim 1, wherein said flange port having a flange port diameter that is at least fifty percent of said housing height of said housing and said bearing assembly after said bearing assembly is positioned with said housing.

11. The system of claim 1, wherein said attachment member having a plurality of openings for alignment with said lower member.

12. The system of claim 1, further comprising:

a rod having a rod thread disposed in one of said plurality of openings; and a nut removably positioned with said rod thread, wherein said rod and said nut disposed between said conduit and said lower member.

13. A rotating control apparatus, comprising:

an outer member;

an inner member disposed with said outer member, said inner member having a longitudinal passage;

a seal having a height and supported from one of said members and with the passage;

a plurality of bearings disposed between said outer member and said inner member so that one member is rotatable relative to the other member;

said seal extending inwardly from the plurality of bearings;

a housing having a height to receive at least a portion of said inner member and said outer member and said housing having a lateral port;

a flange having an outer diameter and a port, wherein said housing port communicating with said flange port while being aligned with said seal, wherein said flange outer diameter is at least eighty percent of said housing height; and a conduit disposed between said housing port and said flange, wherein said conduit having a width perpendicular to a height, and wherein said conduit width being greater than said conduit height at said housing port.

14. The apparatus of claim 13, further comprising an attachment member for attaching said housing to a lower member.

15. The apparatus of claim 13, wherein said flange outer diameter is substantially the same as said housing height.

16. The apparatus of claim 15, wherein said flange port having a flange port diameter that is at least fifty percent of said housing height.

17. The apparatus of claim 13, wherein said seal height is greater than fifty percent of said housing height.

18. The apparatus of claim 17, wherein said flange port having a flange port diameter that is at least fifty percent of said housing height.

19. The apparatus of claim 13, wherein said seal being fabricated from a rubber and said seal height is greater than fifty percent of said housing height.

20. The apparatus of claim 13, further comprising an attachment member for attaching said housing to a lower member, wherein said conduit width is greater than said conduit height for said conduit positioned above said attachment member, and said flange port is substantially circular.

21. The apparatus of claim 13, wherein said housing lateral port, and said flange port, each defining a flow area and all of said flow areas being aligned with said seal.

22. The apparatus of claim 13, wherein said flange port having a flange port diameter that is at least fifty percent of said housing height.

23. The apparatus of claim 13, wherein said attachment member having a plurality of openings for alignment of said housing with said lower member.

24. The apparatus of claim 23, further comprising:

a rod having a rod thread disposed in one of said plurality of openings; and a nut removably positioned with said rod thread, wherein said rod and said nut disposed between said conduit and said lower member.

25. A system for managing the pressure of a fluid in a borehole while sealing a rotatable tubular, the system comprising:

a housing having a height and communicating with the borehole, said housing having a lateral port defining a flow area;

an outer member having an end rotatably adapted with an inner member having an end and having a longitudinal passage through which the tubular may extend;

a plurality of bearings between said inner member and said outer member;

a seal fabricated from a rubber having a height and supported by one of said members and configured for sealing with the rotatable tubular;

said housing lateral port communicating with said rubber seal;

a non-rubber support member for removably supporting said rubber seal with one of said members end wherein said rubber seal having height so that said seal height is greater than fifty percent of said housing height, wherein said rubber seal is aligned with all of said housing lateral port flow area;

a flange having a port defining a flow area, wherein said housing lateral port communicating with said flange port and all of said flange port flow area and all of said housing lateral port flow area aligned with said seal; and a conduit disposed between said housing lateral port and said flange, wherein said conduit having a width perpendicular to a height, and wherein said conduit width being greater than said conduit height at said housing port.

26. The system of claim 25, further comprising:

an attachment member for attaching said housing to a lower member.

27. The system of claim 25, wherein said conduit width is greater than said conduit height for said conduit positioned above said attachment member, and said flange port is substantially circular.

28. The system of claim 27, wherein said housing lateral port, said flange port and said conduit each having a flow area and all of said flow areas being aligned with said seal.

29. The system of claim 25, wherein said conduit is flexible.

30. The system of claim 25, wherein said flange having a flange outer diameter and wherein said flange outer diameter is at least eighty percent of said housing height.

31. The system of claim 25, wherein said flange having a flange outer diameter and wherein said flange outer diameter is substantially the same as said housing height.

32. The system of claim 25, wherein said flange having a flange outer diameter and wherein said flange outer diameter is at least eighty percent of said housing height.

33. The system of claim 25, wherein said flange port having a flange port diameter that is at least fifty percent of said housing height.

34. The system of claim 25, wherein said flange port having a flange port diameter.

35. The system of claim 25, wherein said attachment member having a plurality of openings for alignment with said lower member.

36. The system of claim 35, further comprising:
a rod having a rod thread disposed in one of said plurality of openings; and
a nut removably positioned with said rod thread,
wherein said rod and said nut disposed between said conduit and said lower member.

37. A rotating control apparatus, comprising:
an outer member;
an inner member disposed with said outer member, said inner member having a longitudinal passage;
a seal having a height and supported from one of said members and with the passage;
a plurality of bearings disposed between said outer member and said inner member so that one member is rotatable relative to the other member;
said seal extending inwardly from the plurality of bearings;
a housing having a height to receive at least a portion of said inner member and said outer member and said housing having a lateral port;
a flange having an outer diameter and a port, wherein said flange port having a flange port diameter and wherein said housing port communicating with said flange port diameter while being aligned with said seal wherein said flange port diameter is at least fifty percent of said housing height; and
a conduit disposed between said housing port and said flange, wherein said conduit having a width perpendicular to a height wherein said conduit width being greater than said conduit height at said housing lateral port.

38. The apparatus of claim 37, wherein said flange outer diameter is substantially the same as said housing height.

39. The apparatus of claim 37, wherein said flange outer diameter is at least eighty percent of said housing height.

40. The apparatus of claim 37, wherein said seal height is greater than fifty percent of said housing height.

41. The apparatus of claim 37, wherein said housing lateral port, and said flange port each defining a flow area and all of said flow areas being aligned with said seal.

42. The apparatus of claim 37, further comprising an attachment member for attachment of said housing with a lower member.

43. The apparatus of claim 42, wherein said conduit width is greater than said conduit height for said conduit positioned above said attachment member, and said flange port is substantially circular.

44. The system of claim 43, wherein said attachment member having a plurality of openings for alignment with said lower member.

45. The system of claim 44, further comprising:
a rod having a rod thread disposed in one of said plurality of openings; and
a nut removably positioned with said rod thread,
wherein said rod and said nut disposed between said conduit and said lower member.

46. A system for forming a borehole using a rotatable tubular, the system comprising:
a housing having a height and disposed above the borehole, said housing having a lateral port defining a flow area;
a bearing assembly having an inner member and an outer member and being positioned with said housing, one of said members rotatable with the tubular relative to the other said member and one of said members having a longitudinal passage through which the tubular may extend;
a seal aligned with all of said housing lateral port flow area and having a height to sealably engage the rotatable tubular with said bearing assembly;
a plurality of bearings disposed between said inner member and said outer member;
a flange having an outer diameter and a port, wherein said housing port communicating with said flange port;
a lower member above the borehole;
an attachment member for attaching said housing to said lower member;
wherein said flange outer diameter is at least eighty percent of said housing height of said housing and said bearing assembly after said bearing assembly is positioned with said housing; and
a conduit disposed between said housing port and said flange, wherein said conduit having a width perpendicular to a height, and wherein said conduit width being greater than said conduit height at said housing lateral port.

47. A system for managing the pressure of a fluid in a borehole while sealing a rotatable tubular, the system comprising:
a housing having a height and communicating with the borehole, said housing having a lateral port;
an outer member having an end rotatably adapted with an inner member having an end and having a longitudinal passage through which the tubular may extend;
a plurality of bearings between said inner member and said outer member;
a seal having a height and supported by one of said members for sealing with the rotatable tubular;
said housing port communicating with and aligned with said seal;
a support member configured for threadably supporting said seal with said inner member;
a flange having an outer diameter and a port, wherein said flange port having a flange port diameter and wherein said housing port communicating with said flange port while being aligned with said seal wherein said flange port diameter is at least fifty percent of said housing height and
a conduit disposed between said housing port and said flange, wherein said conduit having a width perpendicular to a height, and wherein said conduit width being greater than said conduit height at said housing lateral port.

48. The system of claim 47, further comprising:
an attachment member for attaching said housing to a lower member.

49. The system of claim 48, wherein said attachment member having a plurality of openings for alignment with said lower member.

50. The system of claim 49, further comprising:
a rod having a rod thread disposed in one of said plurality of openings; and
a nut removably positioned with said rod thread,
wherein said rod and said nut disposed between said conduit and said lower member.

51. A rotating control apparatus, comprising:
an outer member;
an inner member disposed with said outer member, said inner member having a longitudinal passage;
a seal having a height and supported from one of said members and with the passage, wherein said seal height is greater than fifty percent of said housing height;
a plurality of bearings disposed between said outer member and said inner member so that one member is rotatable relative to the other member;
said seal extending inwardly from the plurality of bearings;

a housing having a height to receive at least a portion of said inner member and said outer member and said housing having a lateral port;

a flange having an outer diameter and a port, wherein said housing port communicating with said flange port while being aligned with said seal, wherein said flange outer diameter is at least eighty percent of said housing height, and a conduit disposed between said housing port and said flange, wherein said conduit having a width perpendicular to a height, and wherein said conduit width being greater than said conduit height at said housing port.

52. The system of claim 51, further comprising an attachment member for aligning said housing, wherein said attachment member having a plurality of openings for alignment with said lower member.

53. The system of claim 52, further comprising:

a rod having a rod thread disposed in one of said plurality of openings; and a nut removably positioned with said rod thread, wherein said rod and said nut disposed between said conduit and said lower member.

* * * * *